US009199465B2

(12) United States Patent
Harajiri et al.

(10) Patent No.: US 9,199,465 B2
(45) Date of Patent: Dec. 1, 2015

(54) LIQUID JET HEAD, METHOD OF MANUFACTURING LIQUID JET HEAD, AND LIQUID JET APPARATUS

(71) Applicant: SII PRINTEK INC., Chiba (JP)

(72) Inventors: Toshihiko Harajiri, Chiba (JP); Yuzuru Kubota, Chiba (JP); Satoshi Horiguchi, Chiba (JP)

(73) Assignee: SII PRINTEK INC. (JP)

( * ) Notice: Subject to any disclaimer, the term of this patent is extended or adjusted under 35 U.S.C. 154(b) by 0 days.

(21) Appl. No.: 14/156,606

(22) Filed: Jan. 16, 2014

(65) Prior Publication Data

US 2014/0218444 A1 Aug. 7, 2014

(30) Foreign Application Priority Data

Feb. 6, 2013 (JP) ..... 2013-021628

(51) Int. Cl.

| | |
|---|---|
| ***B41J 2/015*** | (2006.01) |
| ***B41J 2/16*** | (2006.01) |
| ***B41J 2/14*** | (2006.01) |

(52) U.S. Cl.

CPC ..... *B41J 2/1631* (2013.01); *B41J 2/14209* (2013.01); *B41J 2002/14491* (2013.01); *B41J 2202/18* (2013.01); *Y10T 29/42* (2015.01)

(58) Field of Classification Search

None

See application file for complete search history.

(56) References Cited

U.S. PATENT DOCUMENTS

| | | | | |
|---|---|---|---|---|
| 5,625,393 | A * | 4/1997 | Asai | 347/69 |
| 8,596,745 | B2 * | 12/2013 | Koseki | 347/20 |
| 8,596,757 | B2 * | 12/2013 | Koseki | 347/44 |
| 2012/0121797 | A1 * | 5/2012 | Koseki | 427/77 |

FOREIGN PATENT DOCUMENTS

| | | |
|---|---|---|
| EP | 2130678 | 12/2009 |
| EP | 2390095 | 11/2011 |
| EP | 2492095 | 8/2012 |
| JP | 8174822 | 7/1996 |
| JP | 2002361861 | 12/2002 |
| JP | 2012101437 | 5/2012 |

OTHER PUBLICATIONS

IPO Search Report mailed Jul. 29, 2014 issued in British Patent Appln. No. GB1402029.1.

* cited by examiner

*Primary Examiner* — Erica Lin

(74) *Attorney, Agent, or Firm* — Adams & Wilks

(57) ABSTRACT

A liquid jet head includes an actuator substrate having a principal surface on which ejection channels and non-ejection channels are formed, common electrodes formed on side surfaces of the ejection channels, individual electrodes formed on side surfaces of the non-ejection channels, individual electrode pads for connection to the individual electrodes, and common electrode pads for connection to the common electrodes. A groove is formed on the principal surface of the actuator substrate for isolating the individual electrode pads and the common electrode pads from one another. An external substrate has individual electrode terminals and common electrode terminals for connection to the individual electrode pads and common electrode pads, respectively. A connection wiring that connects the common electrode terminals to each other is formed along the groove to prevent an electrical short circuit between the connection wiring and the individual electrodes.

19 Claims, 14 Drawing Sheets

LIQUID JET HEAD, METHOD OF MANUFACTURING LIQUID JET HEAD, AND LIQUID JET APPARATUS

BACKGROUND

1. Technical Field

The present invention relates to a liquid jet head, a method of manufacturing the liquid jet head, and a liquid jet apparatus.

2. Related Art

Conventionally, as an apparatus that jets liquid such as ink onto a recording medium such as a recording paper to record a character or a figure thereon, a liquid jet recording apparatus that includes a so-called ink jet type liquid jet head which jets liquid from a plurality of nozzle holes toward a recording medium has been known.

There is known a liquid jet head that includes an actuator substrate and a flexible substrate. The actuator substrate includes ejection channels which are elongated in a direction from the front end to the rear end of the surface of the substrate, separated from each other by partition walls, and arrayed in a direction that is perpendicular to the elongated direction, drive electrodes which are formed on side faces of the partition walls and include common electrodes and individual electrodes, and extracting electrodes which are electrically connected to the drive electrodes and formed on the surface of the actuator substrate near the rear end thereof. The flexible substrate is adhered to the surface of the actuator substrate near the rear end thereof and includes wiring electrodes which are electrically connected to the extracting electrodes. In the liquid jet head, drive voltage is applied to the drive electrodes to thereby deform the side faces of the ejection channels. Accordingly, the pressure inside the ejection channels is increased to jet ink inside the ejection channels from nozzle holes.

The wiring electrodes formed on the flexible substrate include a common wiring electrode which is connected to the common electrodes formed on the side faces of the ejection channels and an individual wiring electrode which is connected to the individual electrodes formed on the side faces of the non-ejection channels. The common wiring electrode on the flexible substrate is formed into an elongated shape along the width direction in order to electrically connect the common electrodes on the ejection channels arrayed in the width direction to each other so as to be GND potential.

In the liquid jet head having the above configuration, when the flexible substrate is adhered to the surface of the actuator substrate near the rear end thereof, the common wiring electrode of the flexible substrate and the individual electrodes formed on the side faces of the non-ejection channels of the actuator substrate intersect each other. In this case, when the common wiring electrode and the individual electrodes come into contact with each other and short circuit therebetween thereby occurs, it is not possible to apply drive voltage to the drive electrodes. As a result, it is not possible to eject liquid from the nozzle holes.

In order to solve the above problem, for example, JP 2012-101437A discloses a liquid jet head in which corners between the side faces of grooves constituting non-ejection channels and the surface of an actuator substrate are cut in the depth direction to form chamfered portions in common wiring intersecting regions in which a common wiring electrode and drive electrodes (individual electrodes) intersect each other, and the upper ends of the individual electrodes are formed at positions deeper than the surface of the actuator substrate. According to such a configuration, the upper ends of the individual electrodes can be separated from the common wiring electrode on the flexible substrate which abuts on the surface of the actuator substrate to thereby electrically separate the common wiring electrode and the individual electrodes from each other. Therefore, electrical short circuit between the common wiring electrode and the individual electrodes does not occur.

SUMMARY

However, in a conventional liquid jet head, since corners between side faces and top surfaces of two partition walls which form a non-ejection channel are cut to form chamfered portions, it is necessary to individually perform cutting on a plurality of non-ejection channels, and manufacturing man-hours therefore increase. Therefore, there is still room for improvement in cost reduction by reducing the manufacturing man-hours.

In view of the above, the present invention is directed to provide a low-cost liquid jet head that is capable of preventing electrical short circuit between wiring on an external substrate and an electrode on an actuator substrate, a method of manufacturing the liquid jet head, and a liquid jet apparatus provided with the liquid jet head.

In order to solve the above problem, a liquid jet head of the present invention includes: an actuator substrate including a plurality of ejection channels communicating with nozzle holes configured to eject liquid therefrom and a plurality of non-ejection channels configured to be incapable of ejecting the liquid therefrom, the ejection channels and the non-ejection channels being opened at least on a first principal face of the actuator substrate and arrayed in a width direction perpendicular to a longitudinal direction of the ejection channels and the non-ejection channels on the first principal face; a plurality of common electrodes formed on side faces of the ejection channels; and a plurality of individual electrodes formed on side faces of the non-ejection channels. The actuator substrate further include: a plurality of individual electrode pads configured to be connected to the individual electrodes, the individual electrode pads being formed on an end on a first side in the longitudinal direction of the first principal face of the actuator substrate; a plurality of common electrode pads configured to be connected to the common electrodes, the common electrode pads being formed on a second side in the longitudinal direction with respect to the individual electrodes on the first principal face of the actuator substrate; and a groove formed along the width direction between the individual electrode pads and the common electrode pads on the first principal face of the actuator substrate.

According to the present invention, the groove is formed along the width direction between the individual electrode pads and the common electrode pads on the first principal face of the actuator substrate. Therefore, when the external substrate is connected to the actuator substrate, by arranging wiring of the external substrate at the position corresponding to the groove of the actuator substrate, it is possible to prevent contact between the wiring of the external substrate and the individual electrode pads of the actuator substrate. Therefore, it is possible to prevent electrical short circuit between the wiring of the external substrate and the individual electrode pads and the individual electrodes connected to the individual electrode pads of the actuator substrate. Further, since electrical short circuit between the wiring of the external substrate and the individual electrode pads and the individual electrodes of the actuator substrate can be prevented merely by forming the groove, it is possible to obtain the liquid jet head at low cost.

The liquid jet head further includes an external substrate configured to be connected to the actuator substrate. The external substrate includes: a plurality of individual electrode terminals formed at positions corresponding to the individual electrode pads of the actuator substrate, the individual electrode terminals being configured to be connected to the individual electrode pads; a plurality of common electrode terminals formed at positions corresponding to the common electrode pads of the actuator substrate, the common electrode terminals being configured to be connected to the common electrode pads; and connection wiring configured to connect the common electrode terminals to each other, the connection wiring being formed at a position corresponding to the groove of the actuator substrate between the individual electrode terminals and the common electrode terminals.

According to the present invention, the external substrate which is connected to the actuator substrate has the connection wiring which is formed at the position corresponding to the groove of the actuator substrate and connects the common electrode terminals to each other. Therefore, when the external substrate is connected to the actuator substrate, the connection wiring of the external substrate can be reliably arranged at the position corresponding to the groove of the actuator substrate. Therefore, it is possible to prevent electrical short circuit between the connection wiring of the external substrate and the individual electrode pads and the individual electrodes of the actuator substrate. Further, since electrical short circuit between the connection wiring of the external substrate and the individual electrode pads and the individual electrodes of the actuator substrate can be prevented merely by forming the groove, it is possible to obtain the liquid jet head at low cost.

The actuator substrate further includes a plurality of shallow grooves which are shallower than the ejection channels and formed on the first side with respect to the ejection channels on the first principal face of the actuator substrate from ends on the first side of the ejection channels toward an end face on the first side of the actuator substrate. Further, the groove is formed so as to intersect the shallow grooves.

According to the present invention, the shallow grooves are formed from the first side ends of the ejection channels toward the first side end face of the actuator substrate. Therefore, when forming the ejection channels, for example, by cutting, the shallow grooves can be formed merely by changing the depth of cutting. Therefore, it is possible to easily form the shallow grooves within the step for forming the ejection channels. Further, the groove is formed so as to intersect the shallow grooves. Therefore, the common electrode pads and the individual electrode pads can be easily formed by forming the groove so as to interest the shallow grooves, for example, by cutting after forming film of the electrode material inside the shallow grooves to thereby divide the film of the electrode material formed inside the shallow grooves by the groove. In this manner, since the common electrode pads and the individual electrode pads can be formed without using a mask, the liquid jet head that can prevent electrical short circuit between the connection wiring of the external substrate and the individual electrode pads and the individual electrodes of the actuator substrate can be formed at low cost.

A step portion located one step lower than the first principal face is formed on an edge on the first side of the actuator substrate.

According to the present invention, the step portion which is located one step lower than the first principal face is formed on the first side edge of the actuator substrate. Therefore, when the external substrate is connected to the first principal face of the actuator substrate, contact between the first side edge in the first principal face of the actuator substrate and the external substrate can be prevented. As a result, it is possible to prevent the external substrate from being damaged.

A corner formed by the first principal face of the actuator substrate and an end face on the first side of the actuator substrate is chamfered.

According to the present invention, the corner formed by the first principal face of the actuator substrate and the first side end face of the actuator substrate is chamfered. Therefore, when the external substrate is connected to the first principal face of the actuator substrate, even if the external substrate makes contact with the chamfered portion of the actuator substrate, damage of the external substrate can be reduced.

The ejection channels and the non-ejection channels are alternately arrayed in the width direction.

According to the present invention, the configuration of the low-cost liquid jet head that can prevent electrical short circuit between the wiring of the external substrate and the electrodes of the actuator substrate can be preferably applied to the liquid jet head in which the ejection channels and the non-ejection channels are alternately arrayed in the width direction.

The nozzle holes are located on ends on the second side of the ejection channels.

According to the present invention, the configuration of the low-cost liquid jet head that can prevent electrical short circuit between the wiring of the external substrate and the electrodes of the actuator substrate can be preferably applied to a so-called edge shoot type liquid jet head.

The nozzle holes are located on a second principal face of the actuator substrate at positions on middle parts in the longitudinal direction of the ejection channels.

According to the present invention, the configuration of the low-cost liquid jet head that can prevent electrical short circuit between the wiring of the external substrate and the electrodes of the actuator substrate can be preferably applied to a so-called side shoot type liquid jet head.

The non-ejection channels are formed from an end face on the first side of the actuator substrate up to an end face on the second side of the actuator substrate. The individual electrode pads are formed across respective adjacent ones of the non-ejection channels.

According to the present invention, the individual electrode pads are formed across respective adjacent ones of the non-ejection channel. Therefore, a wide surface area of each of the individual electrode pads can be ensured. As a result, it is possible to easily connect the terminals (the individual electrode terminals) on the external substrate to the respective individual electrode pads without performing precise positioning of the external substrate. In addition, since a wide cross-sectional area of each of the individual electrode pads can be ensured, electric resistance of the individual electrode pads can be reduced. As a result, the liquid jet head having high electrical efficiency can be achieved.

The width of the common electrode pads and the width of the individual electrode pads are equal to the width of the ejection channels.

According to the present invention, the width of the common electrode pads and the width of the individual electrode pads are equal to the width of the ejection channels. Therefore, it is possible to reduce the width of the common electrode pads and the width of the individual electrode pads as much as possible. As a result, the width of the liquid jet head can be reduced.

A method of manufacturing the liquid jet head according to the present invention includes: a mask material film forming step for forming film of a mask material on a piezoelectric substrate; a mask forming step for patterning the mask material to form a mask having openings at least on regions in which the individual electrode pads and the common electrode pads are to be formed; a channel forming step for forming the ejection channels and the non-ejection channels on the piezoelectric substrate; an electrode film forming step for forming film of an electrode material; a mask material removing step for removing the mask material; and a groove forming step for forming the groove.

According to the present invention, the method of manufacturing the liquid jet head includes the electrode film forming step for forming film of the electrode material after the mask forming step. Therefore, the mask material can be patterned into a desired shape to form the mask, and the electrode material can be formed into film having a desired shape. In addition, since the method includes the groove forming step, the groove can be formed, for example, merely by cutting. As a result, when the external substrate is connected to the actuator substrate, the wiring of the external substrate can be arranged at the position corresponding to the groove of the actuator substrate. Therefore, it is possible to obtain the low-cost liquid jet head that can prevent electrical short circuit between the wiring of the external substrate and the individual electrode pads and the individual electrodes connected to the individual electrode pads of the actuator substrate.

A method of manufacturing the liquid jet head according to the present invention includes: a mask material film forming step for forming film of a mask material on a piezoelectric substrate; a channel forming step for forming the ejection channels and the non-ejection channels on the piezoelectric substrate; an electrode film forming step for forming film of an electrode material; a mask material removing step for removing the mask material; and a groove forming step for forming the groove. In the channel forming step, shallow grooves shallower than the ejection channels are formed on the first side with respect to the ejection channels.

According to the present invention, the method of manufacturing the liquid jet head includes the channel forming step for forming the ejection channels and the non-ejection channels on the piezoelectric substrate after the mask material film forming step. Therefore, when forming the ejection channels and the non-ejection channels, for example, by cutting, the mask material that corresponds to each of the channels can be removed by cutting. Accordingly, the film of the electrode material can be formed on the regions corresponding to the respective channels 6 exposed from the mask material in the next electrode film forming step. Therefore, it is possible to form the film of the electrode material without using a mask patterned by, for example, a photolithography technique to form the common electrodes and the individual electrodes. Further, the shallow grooves which are shallower than the ejection channels are formed in the channel forming step. Therefore, the film of the electrode material can be formed also on the regions corresponding to the shallow grooves exposed from the mask material in the next electrode film forming step. Further, since the method includes the groove forming step for forming the groove, it is possible to easily form the common electrode pads and the individual electrode pads by forming the groove so as to intersect the shallow grooves, for example, by cutting to divide the film of the electrode material formed inside the shallow grooves by the groove. In this manner, since the common electrode pads and the individual electrode pads can be formed without patterning the mask material, the method of manufacturing the liquid jet head can be simplified. Therefore, the liquid jet head that can prevent electrical short circuit between the wiring of the external substrate and the individual electrode pads and the individual electrodes connected to the individual electrode pads of the actuator substrate can be formed at low cost.

A liquid jet apparatus of the present invention includes: the liquid jet head described above; a movement mechanism configured to relatively move the liquid jet head and a recording medium; a liquid supply tube configured to supply liquid to the liquid jet head; and a liquid tank configured to supply the liquid to the liquid supply tube.

According to the present invention, since the liquid jet apparatus includes the low-cost liquid jet head that can prevent electrical short circuit between the wiring of the external substrate and the electrodes of the actuator substrate, it is possible to obtain the liquid jet apparatus with high reliability and low cost.

According to the present invention, the groove is formed along the width direction between the individual electrode pads and the common electrode pads on the first principal face of the actuator substrate. Therefore, when the external substrate is connected to the actuator substrate, by arranging wiring of the external substrate at the position corresponding to the groove of the actuator substrate, it is possible to prevent contact between the wiring of the external substrate and the individual electrode pads of the actuator substrate. Therefore, it is possible to prevent electrical short circuit between the wiring of the external substrate and the individual electrode pads and the individual electrodes connected to the individual electrode pads of the actuator substrate. Further, since electrical short circuit between the wiring of the external substrate and the individual electrode pads and the individual electrodes of the actuator substrate can be prevented merely by forming the groove, it is possible to obtain the liquid jet head at low cost.

DETAILED DESCRIPTION

First Embodiment

Hereinbelow, the first embodiment of the present invention will be described with reference to the accompanying drawings.

Figure 1:
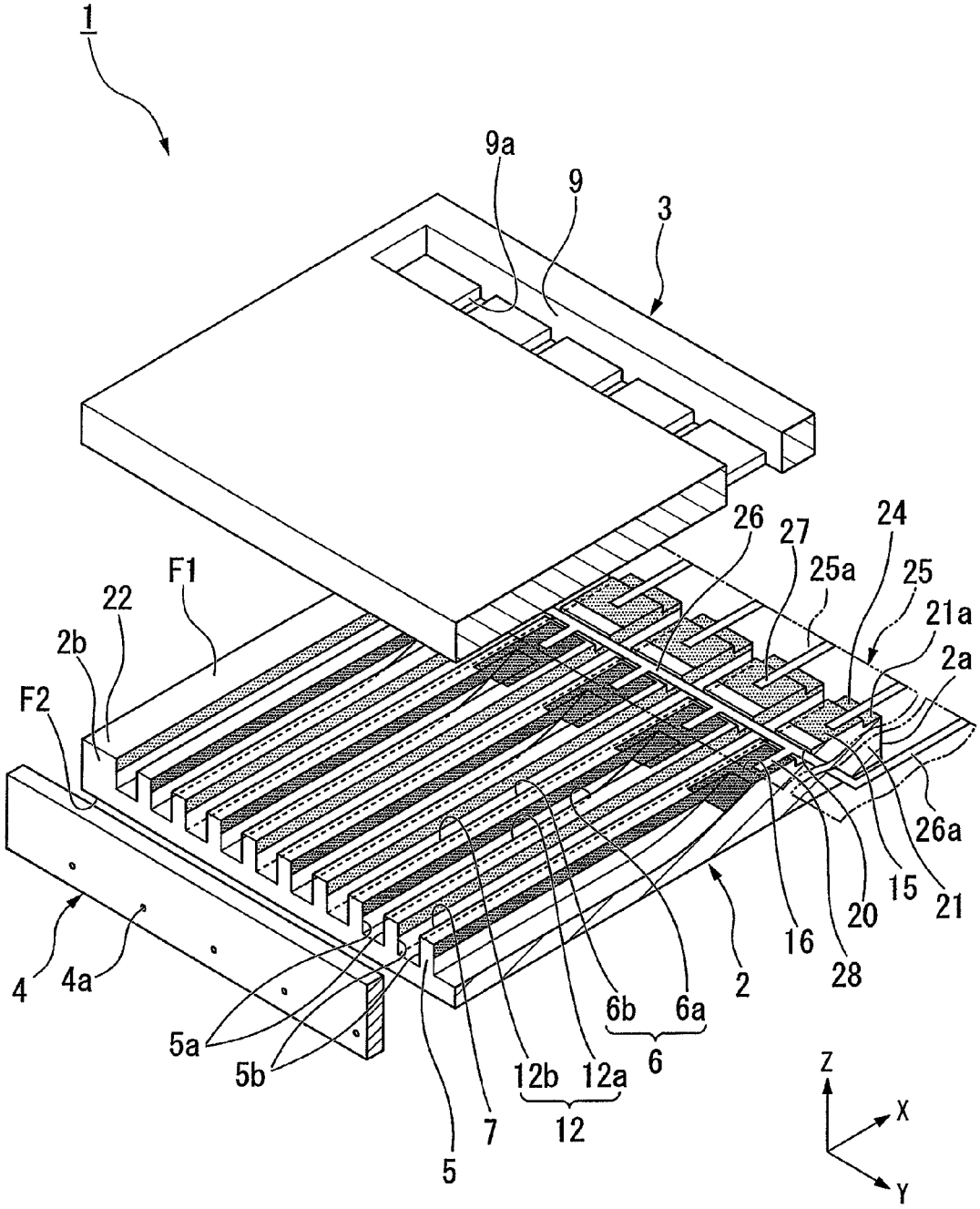
FIG. 1 is a schematic exploded perspective cross-sectional view of a liquid jet head according to a first embodiment.

FIG. 1 is a schematic exploded perspective cross-sectional view of a liquid jet head according to the first embodiment.

As illustrated in FIG. 1, a liquid jet head 1 includes an actuator substrate 2, a cover plate 3, a nozzle plate 4, and a flexible substrate 25 (corresponding to an external substrate). For the purpose of easy understanding, a substrate portion 25*a* of the flexible substrate 25 is indicated by a two-dot chain line in FIG. 1.

The actuator substrate 2 is partitioned by walls 5. A plurality of channels 6 including ejection channels 6*a* and non-ejection channels 6*b* are arrayed on the actuator substrate 2. The channels 6 are opened on a first principal face F1 of the actuator substrate 2.

The cover plate 3 is placed on the actuator substrate 2 so as to cover openings 7 of the channels 6 on the first principal face F1, and includes a liquid supply chamber 9 which supplies liquid to the ejection channels 6*a* on a first side in the longitudinal direction of the channels 6.

The flexible substrate 25 is adhered to the first principal face F1 of the actuator substrate 2 at an end 21 located on the first side in the longitudinal direction of the channels 6.

The nozzle plate 4 includes nozzle holes 4*a* which communicate with the respective ejection channels 6*a*. The nozzle plate 4 is bonded to an end face 2*b* of the actuator substrate 2 at an end 22 located on the second side of the actuator substrate 2. The nozzle holes 4*a* are located at the end 22 on the second side in the longitudinal direction of the ejection channels 6*a*, and can eject liquid therefrom. The nozzle holes 4*a* do not communicate with the non-ejection channels 6*b*. Therefore, the non-ejection channels 6*b* cannot eject liquid therefrom.

In the following description, the longitudinal direction in which the channels 6 extend is defined as an X direction. The first side in the X direction on which the liquid supply chamber 9 is arranged is defined as a +X side, and the second side opposite thereto is defined as a −X side. Further, the width direction of the channels 6, the width direction being perpendicular to the X direction on the first principal face F1, is defined as a Y direction. The left side of FIG. 1 is defined as a −Y side, and the right side of FIG. 1 is defined as +Y side. Further, a direction that is perpendicular to the X direction and the Y direction is defined as a Z direction. The same side as the first principal face F1 is defined as a +Z side, and the same side as a second principal face F2 that is located opposite to the first principal face F1 is defined as a −Z side. Hereinbelow, details of each of the components of the liquid jet head 1 will be described using an XYZ orthogonal coordinate system as necessary.

(Actuator Substrate)

Hereinbelow, each of the components of the liquid jet head 1 will be described in detail.

Figure 2:
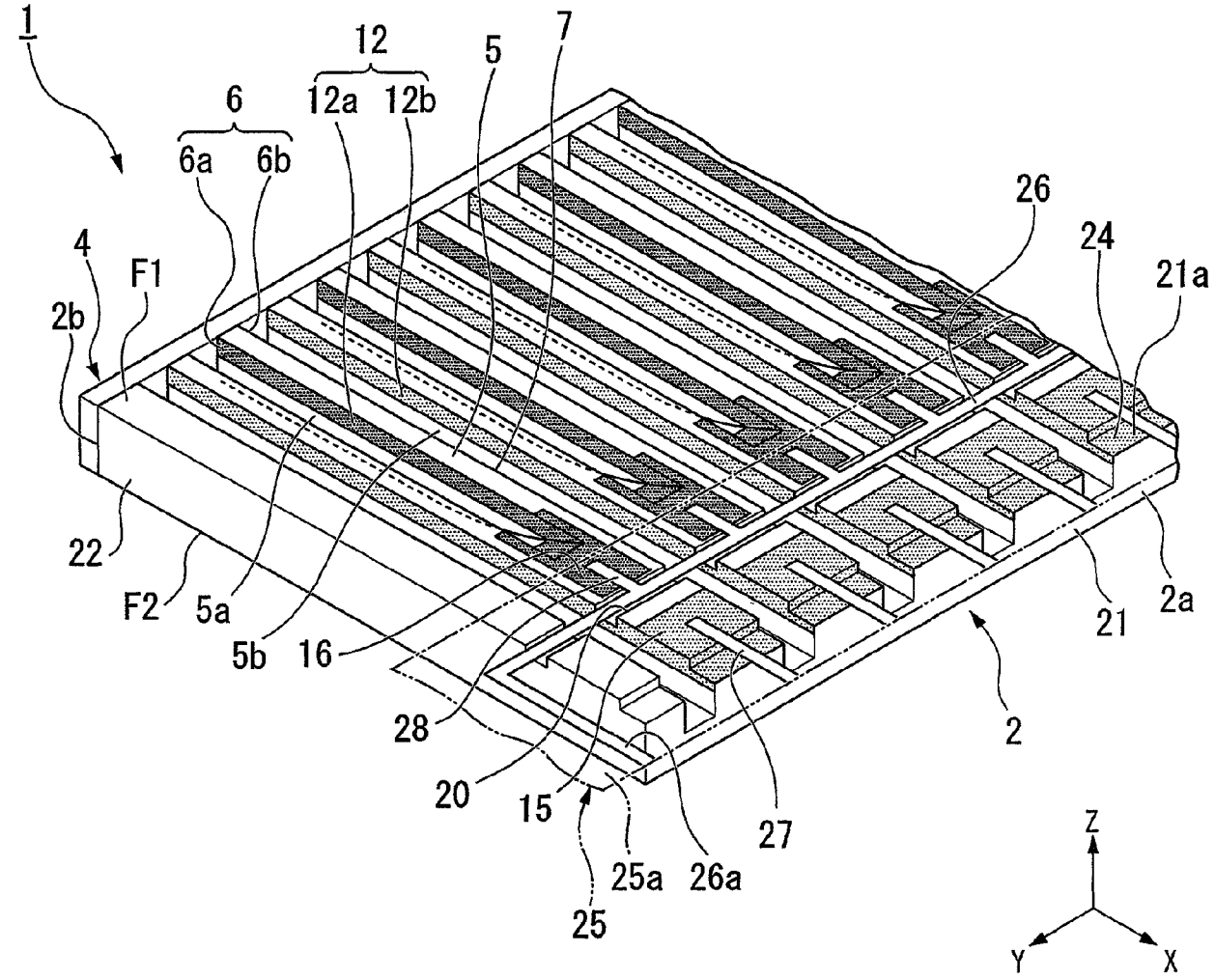
FIG. 2 is a perspective view of an actuator substrate according to the first embodiment.

FIG. 2 is a perspective view of the actuator substrate 2. For the purpose of easy understanding, the substrate portion 25*a* of the flexible substrate 25 is indicated by a two-dot chain line in FIG. 2.

As illustrated in FIG. 2, the actuator substrate 2 is a generally rectangular plate which is formed of a piezoelectric material such as lead zirconate titanate (PZT) ceramics polarized in the Z direction. The actuator substrate 2 has a step portion 24 which is formed on a +X side edge 21*a* of the actuator substrate 2 so as to be located one step lower than the first principal face F1 toward the −Z side.

The channels 6 of the actuator substrate 2 are formed by alternately arraying the ejection channels 6*a* and the non-ejection channels 6*b* in the Y direction so as to be parallel to each other.

Each of the ejection channels 6*a* extends from a position before a +X side end face 2*a* of the actuator substrate 2 up to the −X side end face 2*b* of the actuator substrate 2. A +X side end of each of the ejection channels 6*a* is formed so as to be inclined upward from the −Z side (the second principal face F2) of the actuator substrate 2 toward the +Z side (the first principal face F1) thereof.

Each of the non-ejection channels 6*b* extends from the +X side end face 2*a* of the actuator substrate 2 up to the −X side end face 2*b* thereof.

Drive electrodes 12 are formed on side faces of the walls 5 of the actuator substrate 2 of the liquid jet head 1.

The drive electrodes 12 include common electrodes 12*a* which are formed on side faces 5*a* of the ejection channels 6*a* and individual electrodes 12*b* which are formed on side faces 5*b* of the non-ejection channels 6*b*.

The common electrodes 12*a* are formed on the side faces 5*a* of respective pairs of the walls 5 facing the ejection channels 6*a* from the +X side ends up to the −X ends thereof so as to extend in a generally band shape along the X direction.

The individual electrodes 12*b* are formed on the side faces 5*b* of respective pairs of walls 5 facing the non-ejection channels 6*b* from the +X side ends up to the −X end thereof so as to extend in a generally band shape along the X direction.

The common electrodes 12*a* are formed in regions located on the +Z side with respect to the centers in the Z direction of the ejection channels 6*a* (that is, the depth direction of the ejection channels 6*a*). The individual electrodes 12*b* are formed in regions located on the +Z side with respect to the centers in the Z direction of the non-ejection channels 6*b* (that is, the depth direction of the non-ejection channels 6*b*).

A plurality of individual electrode pads 15 is formed on the first principal face F1 of the actuator substrate 2 at the +X side end 21 thereof. The individual electrode pads 15 are formed on the first principal face F1 and the surface of the step portion 24 at the +X side end 21 of the actuator substrate 2. The individual electrode pads 15 in the present embodiment are formed across respective adjacent ones of the non-ejection channels 6*b*. Each of the individual electrode pads 15 electrically connects individual electrodes 12*b* to each other, the individual electrodes 12 being formed on side faces 5*b* of walls 5 of non-ejection grooves 6*b* that are adjacent to each other, at the +X side end 21 of the actuator substrate 2.

A plurality of common electrode pads 16 are formed on the first principal face F1 of the actuator substrate 2 at positions located on the −X side with respect to the individual electrode pads 15. The common electrode pads 16 are connected to the +X side ends of the respective ejection channels 6*a* on the first principal face F1. In the present embodiment, the width in the Y direction of the common electrode pads 16 is wider than the width in the Y direction of the ejection channels 6*a* and narrower than the distance between adjacent ones of the non-ejection channels 6*b*. Each of the common electrode pads 16 electrically connects common electrodes 12*a* to each other, the common electrodes 12*a* being formed on facing side faces 5*a* of an ejection channel 6*a*, at the +X side end of the ejection channel 6*a* on the first principal face F1 of the actuator substrate 2.

A line of groove 20 is formed between the individual electrode pads 15 and the common electrode pads 16 on the first principal face F1 of the actuator substrate 2. The groove 20 is formed along the Y direction so as to be perpendicular to the non-ejection channels 6*b*. The groove 20 has a predetermined width in the X direction and a predetermined depth in the Z direction. The groove 20 is formed on the first principal face F1 of the actuator substrate 2 throughout the entire length in the Y direction thereof.

The width in the X direction of the groove 20 is wider than the width in the X direction of connection wiring 26 (described later) which is formed on the flexible substrate 25.

Further, the depth in the Z direction of the groove 20 is shallower than the depth in the Z direction of the drive electrodes 12 on the side faces of the walls 5. Accordingly, the groove 20 can be formed without dividing the drive electrodes 12 on the side faces of the walls 5.

The cover plate 3 is a generally rectangular plate which is formed of, for example, PZT ceramics which is the same material as the actuator substrate 2. The material forming the cover plate 3 is not limited to PZT ceramics. For example, machinable ceramics, other kinds of ceramics, and a low dielectric material such as glass may be used. However, when the cover plate 3 and the actuator substrate 2 are formed of the same material, thermal expansion can be made equal to each other in the cover plate 3 and the actuator substrate 2. Therefore, warpage or deformation of the liquid jet head 1 caused by temperature change can be prevented. A plurality of slits 9*a* is formed on the bottom of the liquid supply chamber 9 of the cover plate 3. The slits 9*a* are formed at positions corresponding to the respective ejection channels 6*a* so as to penetrate the bottom of the liquid supply chamber 9 in the Z direction. The slits 9*a* extend in the X direction, and are arrayed in the Y direction. The liquid supply chamber 9 communicates with the +X side ends of the ejection channels 6*a* through the slits 9*a*. The liquid supply chamber 9 does not communicate with the non-ejection channels 6*b*.

(Flexible Substrate)

Figure 3:
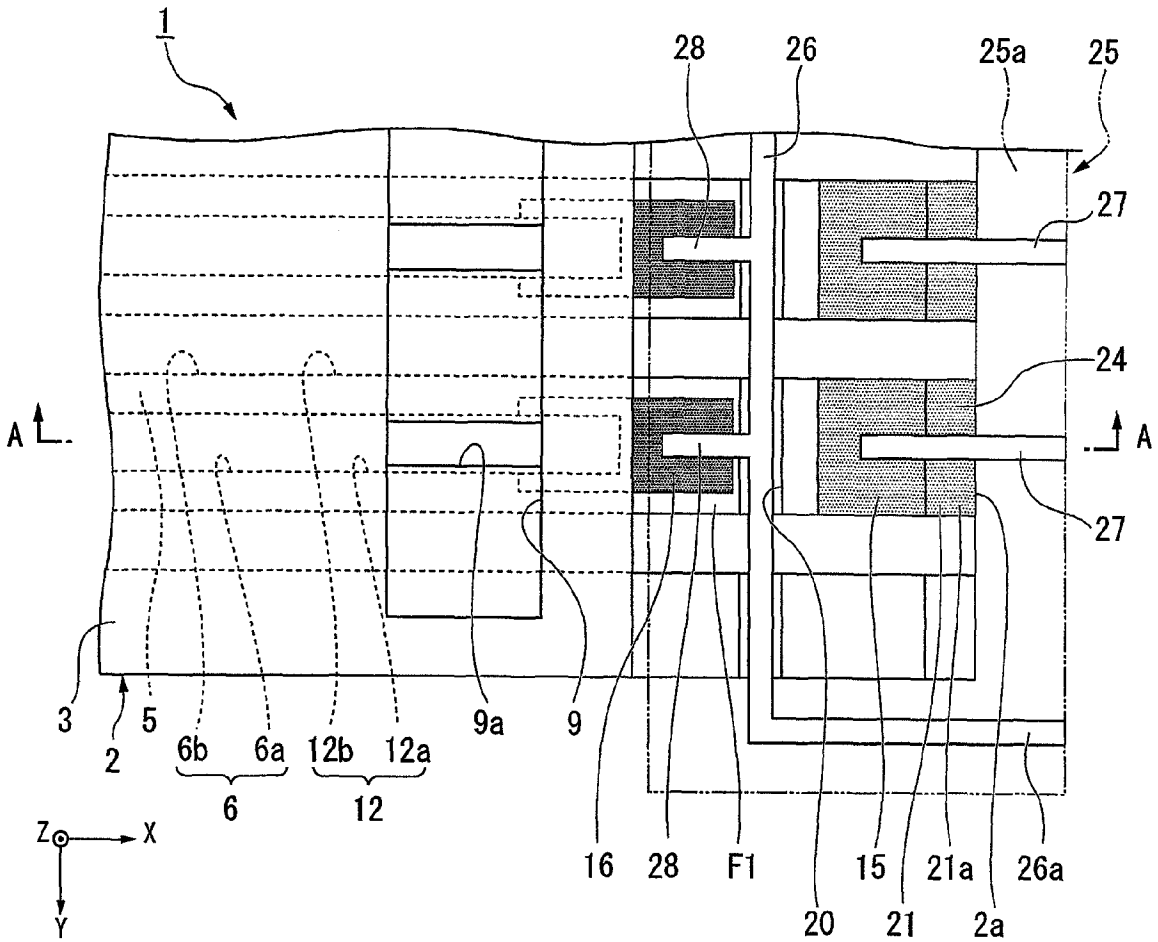
FIG. 3 is a plan view illustrating the liquid jet head according to the first embodiment with a flexible substrate attached to the actuator substrate.

FIG. 3 is a plan view illustrating the liquid jet head 1 with the flexible substrate 25 attached to the actuator substrate 2. For the purpose of easy understanding, the substrate portion 25*a* of the flexible substrate 25 is indicated by a two-dot chain line in FIG. 3.

Figure 4:
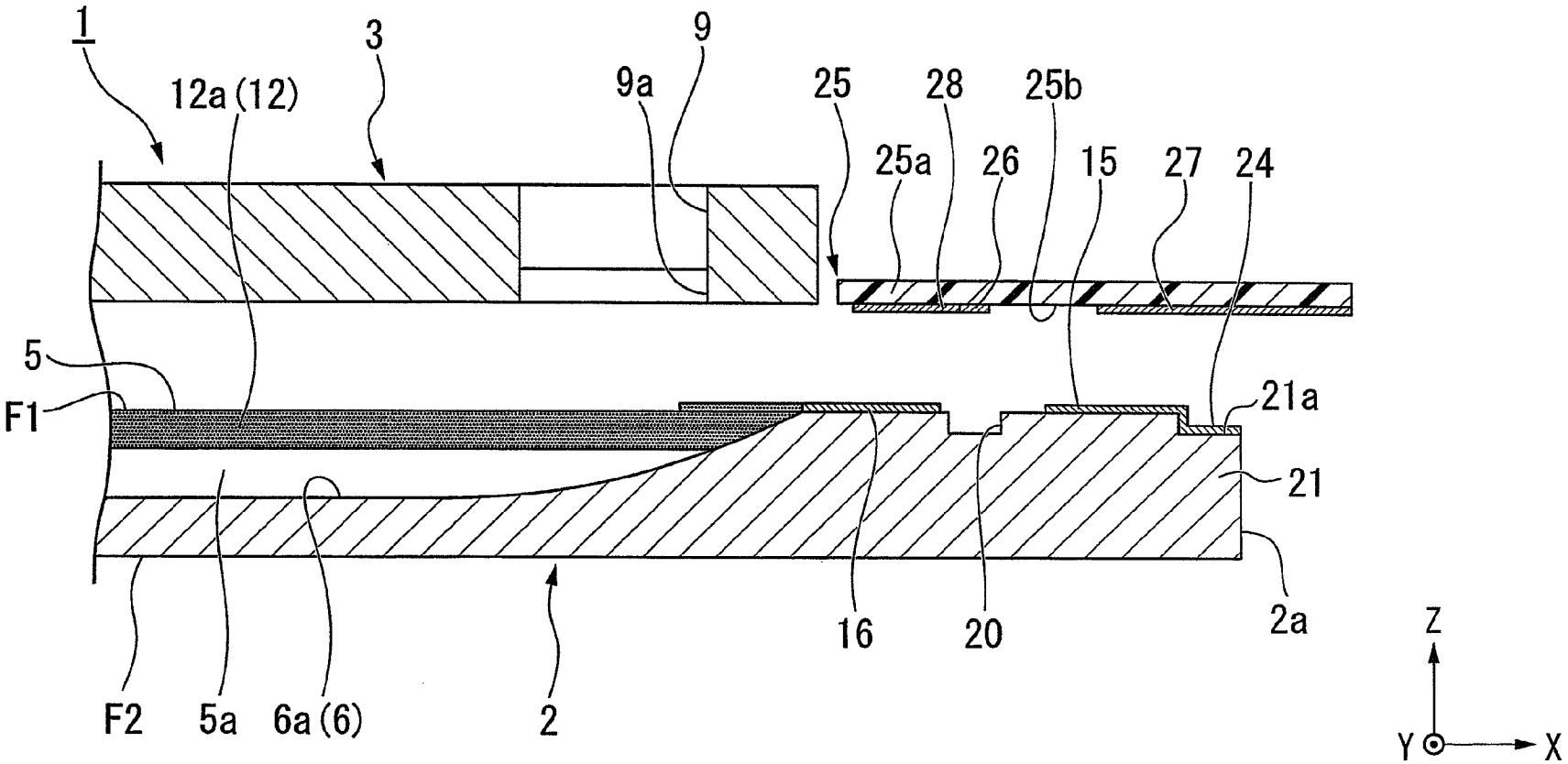
FIG. 4 is a side cross-sectional view taken along line A-A of FIG. 3 when the actuator substrate, a cover plate, and the flexible substrate according to the first embodiment are taken apart.

FIG. 4 is a side cross-sectional view taken along line A-A of FIG. 3 when the actuator substrate 2, the cover plate 3, and the flexible substrate 25 are taken apart.

As illustrated in FIG. 3, the flexible substrate 25 is a film-like flexible member that includes the substrate portion 25*a* which is formed of, for example, a resin material mainly composed of polyimide or the like.

As illustrated in FIG. 4, the flexible substrate 25 includes a plurality of individual electrode terminals 27 and a plurality of common electrode terminals 28 which are formed on a −Z side principal face 25*b* of the flexible substrate 25.

As illustrated in FIG. 3, each of the individual electrode terminals 27 is formed into a generally band shape along the X direction from a +X side end of the flexible substrate 25 up to a position corresponding to the individual electrode pad 15. A pitch between adjacent ones of the individual electrode terminals 27 is substantially the same as a pitch between adjacent ones of the ejection channels 6*a*. Further, the width in the Y direction of the individual electrode terminals 27 is narrower than the width in the Y direction of the individual electrode pads 15.

Each of the common electrode terminals 28 is formed into a generally band shape along the X direction from a position that is located on the −X side with respect to the corresponding individual electrode terminal 27 and corresponds to the groove 20 up to a position that corresponds to the corresponding common electrode pads 16. A pitch between adjacent ones of the common electrode terminals 28 is substantially the same as the pitch between adjacent ones of the ejection channels 6*a* and the pitch between adjacent ones of the individual electrode terminals 27.

The connection wiring 26 is formed on the −Z side principal face 25*b* of the flexible substrate 25 (see FIG. 4). The connection wiring 26 is formed into a generally band shape along the Y direction at a position that is located between the individual electrode terminals 27 and the common electrode terminals 28 and corresponds to the groove 20. The connection wiring 26 electrically connects +X side ends of the common electrode terminals 28 to each other.

The width in the X direction of the connection wiring 26 is sufficiently narrower than the width in the X direction of the groove 20. As illustrated in FIG. 4, the thickness in the Z direction of the connection wiring 26 is thinner than the depth in the Z direction of the groove 20. Accordingly, the connection wiring 26 is arranged without making contact with the actuator substrate 2 in the groove 20. Therefore, the connection wiring 26 is arranged at the position corresponding to the groove 20 without making contact with the individual electrode pads 15 and the drive electrodes 12 formed on the side faces of the walls 5 of the actuator substrate 2.

As illustrate in FIG. 3, the connection wiring 26 has connection wiring terminals 26*a* which are formed on opposite ends in the Y direction thereof (only one of the connection wiring terminals 26*a*, the one being located on the +Y side, is illustrated in FIG. 3). The connection wiring terminals 26*a* extend toward the +X side end of the flexible substrate 25 along the X direction. Each of the connection wiring terminals 26*a* is connected to a ground (GND) via printed wiring (not illustrated) or the like.

The flexible substrate 25 is electrically and mechanically connected to the first principal face F1 of the actuator substrate 2 at the +X side end 21 by adhering the individual electrode terminals 27 and the individual electrode pads 15 of the actuator substrate 2 to each other and adhering the common electrode terminals 28 and the common electrode pads 16 of the actuator substrate 2 to each other using, for example, conductive adhesive. As illustrated in FIG. 4, the step portion 24 which is located one step lower than the first principal face F1 toward the −Z side is formed on the +X side edge 21*a* of the actuator substrate 2. Therefore, when the flexible substrate 25 is connected to the first principal face F1 of the actuator substrate 2, contact between the flexible substrate 25 and the +X side edge 21*a* in the first principal face F1 of the actuator substrate 2 is prevented.

(Method of Manufacturing Liquid Jet Head)

Next, a method of manufacturing the liquid jet head 1 according to the first embodiment described above will be described.

Figure 5:
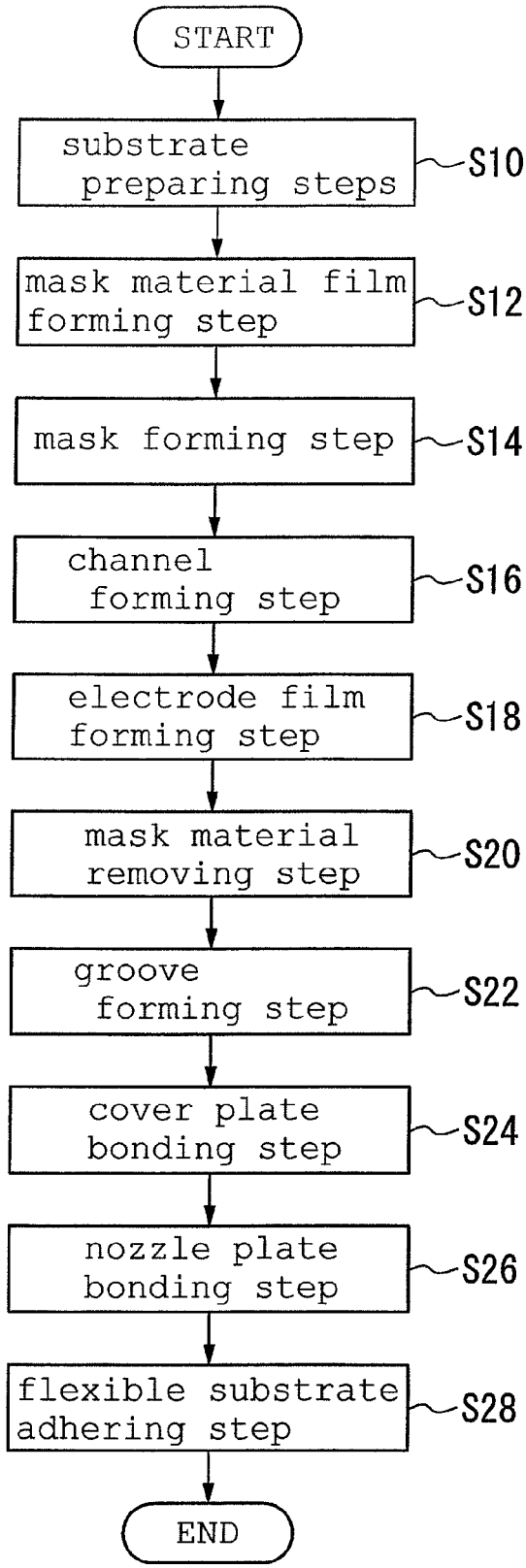
FIG. 5 is a flow chart illustrating main steps in a method of manufacturing the liquid jet head according to the first embodiment.
Figure 6A:
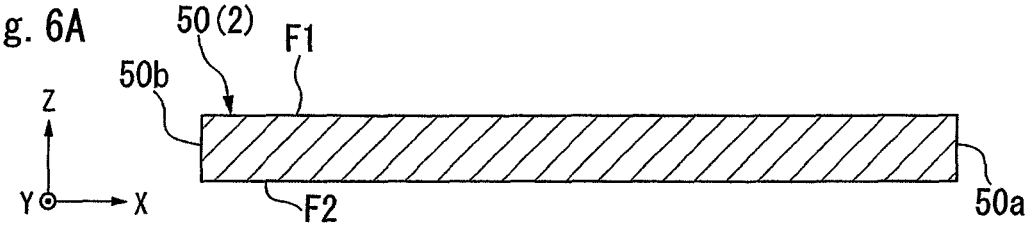
FIGS. 6A to 6F are explanatory drawings for the respective steps in the method of manufacturing the liquid jet head according to the first embodiment.
Figure 6B:
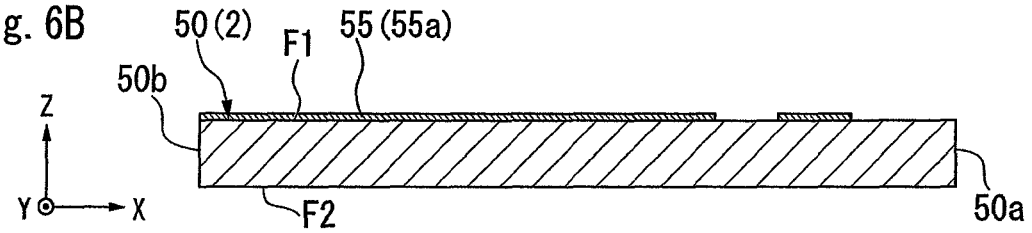
Figure 6C:
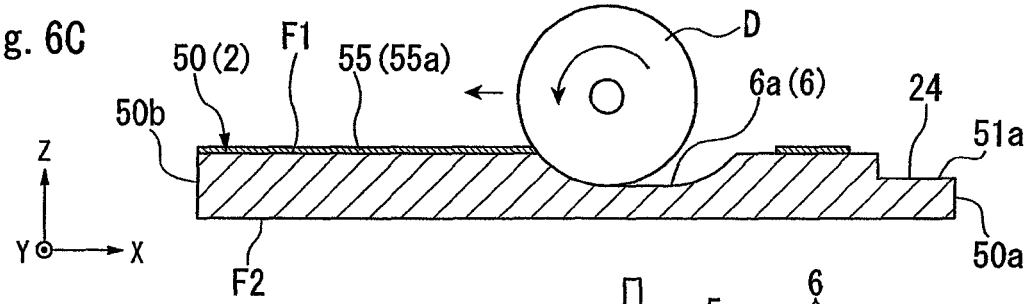
Figure 6D:
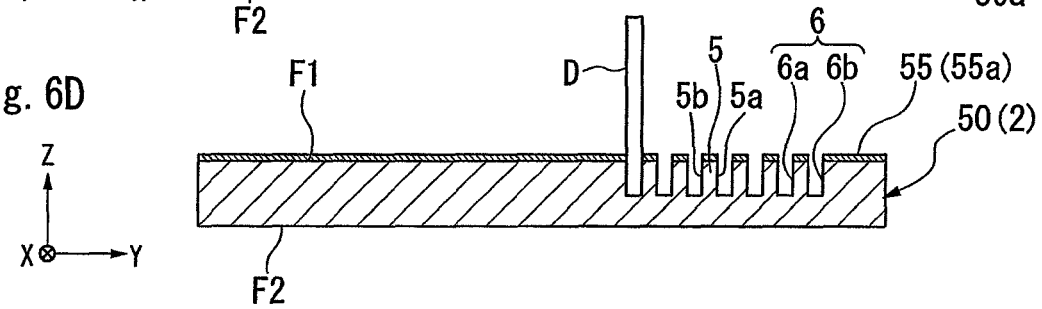
Figure 6E:
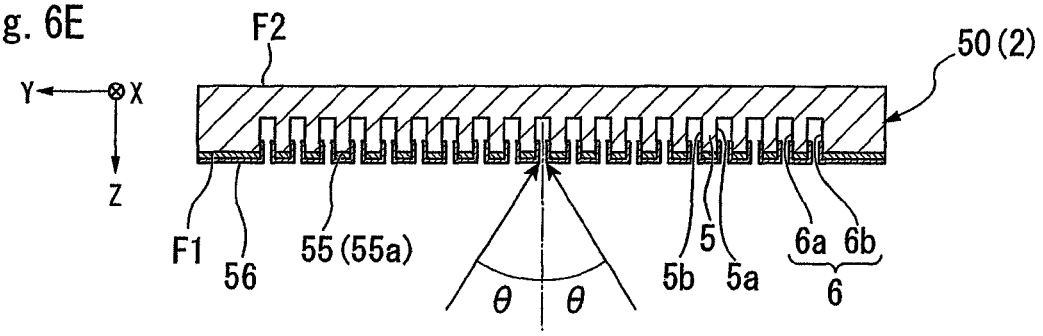
Figure 6F:
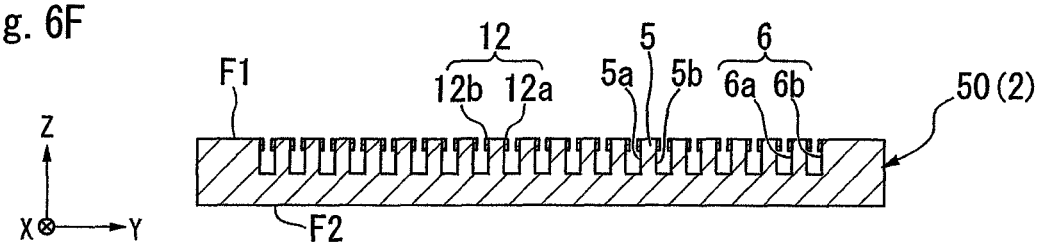

FIG. 5 is a flow chart illustrating main steps in the method of manufacturing the liquid jet head according to the first embodiment. FIGS. 6A to 6F are explanatory drawings for the respective steps in the method of manufacturing the liquid jet head. An XYZ orthogonal coordinate system in FIGS. 6A to 6F corresponds to the XYZ orthogonal coordinate system in FIGS. 1 to 4. FIGS. 6A to 6C correspond to the side cross-sectional view taken along line A-A of FIG. 3. FIGS. 6D to 6F correspond to a cross-sectional view along an YZ plane when viewing a piezoelectric substrate 50 (actuator substrate 2) from the −X side. See FIGS. 1 to 4 in addition to FIG. 6 for reference signs used in the following description regarding the method of manufacturing the liquid jet head.

As illustrated in FIG. 5, the method of manufacturing the liquid jet head according to the first embodiment mainly includes a substrate preparing steps S10, a mask material film forming step S12, a mask forming step S14, a channel forming step S16, an electrode film forming step S18, a mask material removing step S20, a groove forming step S22, a cover plate bonding step S24, a nozzle plate bonding step S26, and a flexible substrate adhering step S28. Hereinbelow, each of the steps S10 to S28 will be described.

In the substrate preparing step S10, as illustrated in FIG. 6A, the piezoelectric substrate 50 which is a base of the actuator substrate 2 is prepared. As a material of the piezoelectric substrate 50, for example, a piezoelectric material such as PZT ceramics polarized in the Z direction is preferably used.

Then, in the mask material film forming step S12, as illustrated in FIG. 6B, film of a mask material 55 which made of, for example, a photosensitive resin is formed on the first principal face F1 of the piezoelectric substrate 50.

Then, in the mask forming step S14, as illustrated in FIG. 6B, a part of the mask material 55 on regions in which electrodes such as the individual electrode pads 15 and the common electrode pads 16 are to be formed is removed, and the other part of the mask material 55 on a region in which no electrode is formed is left thereon by using a photolithography technique to thereby pattern the mask material 55. Accordingly, a mask 55*a* which has openings on the regions in which the individual electrode pads 15 and the common electrode pads 16 are to be formed is formed.

Next, in the channel forming step S16, as illustrated in FIG. 6C, the channels 6 are formed, for example, by cutting the piezoelectric substrate 50 using a dicing blade D. Specifically, each of the ejection channels 6*a* is formed by cutting the first principal face F1 of the piezoelectric substrate 50 together with the mask material 55 from a position before a +X side end face 50*a* of the piezoelectric substrate 50 up to a −X side end face 50*b* of the piezoelectric substrate 50. Further, each of the non-ejection channels 6*b* is formed by cutting the first principal face F1 together with the mask material 55 from the +X side end face 50*a* of the piezoelectric substrate 50 up to the −X side end face 50*b* of the piezoelectric substrate 50. In FIG. 6C, formation of an ejection channel 6*a* is illustrated. In this manner, as illustrated in FIG. 6D, the ejection channels 6*a* and the non-ejection channels 6*b* which are alternately arrayed in the Y direction are formed.

In the channel forming step S16, as illustrated in FIG. 6C, the step portion 24 is formed on a +X side edge 51*a* of the piezoelectric substrate 50 on the same side as the first principal face F1 in addition to the formation of the channels 6. The step portion 24 is formed, for example, by cutting the piezoelectric substrate 50 using the dicing blade D in the same manner as in the channels 6. Specifically, the dicing blade D is moved in the X direction for forming the channels 6, and moved in the Y direction for forming the step portion 24.

Then, in the electrode film forming step S18, as illustrated in FIG. 6E, an electrode material 56 is deposited on the first principal face F1 of the piezoelectric substrate 50 by oblique deposition from two directions that are respectively inclined by a predetermined angle θ toward the +Y side and the −Y side with respect to the Z direction. Accordingly, it is possible to form film of the electrode material 56 on the opposite side faces 5*a* and 5*b* of the walls 5 in regions located on the +Z side with respect to the centers in the Z direction of the ejection channels 6*a* and the non-ejection channels 6*b*.

Then, in the mask material removing step S20, the mask 55*a* (the mask material 55) is removed, for example, by lift-off, and a part of the electrode material 56 deposited on the mask 55*a* is removed at the same time. As a result, as illustrated in FIG. 6F, the rest of the electrode material 56 deposited on the opposite side faces 5*a* and 5*b* of the walls 5 (see FIG. 6E) is separated from each other to form the common electrodes 12*a* and the individual electrodes 12*b*.

Figure 7:
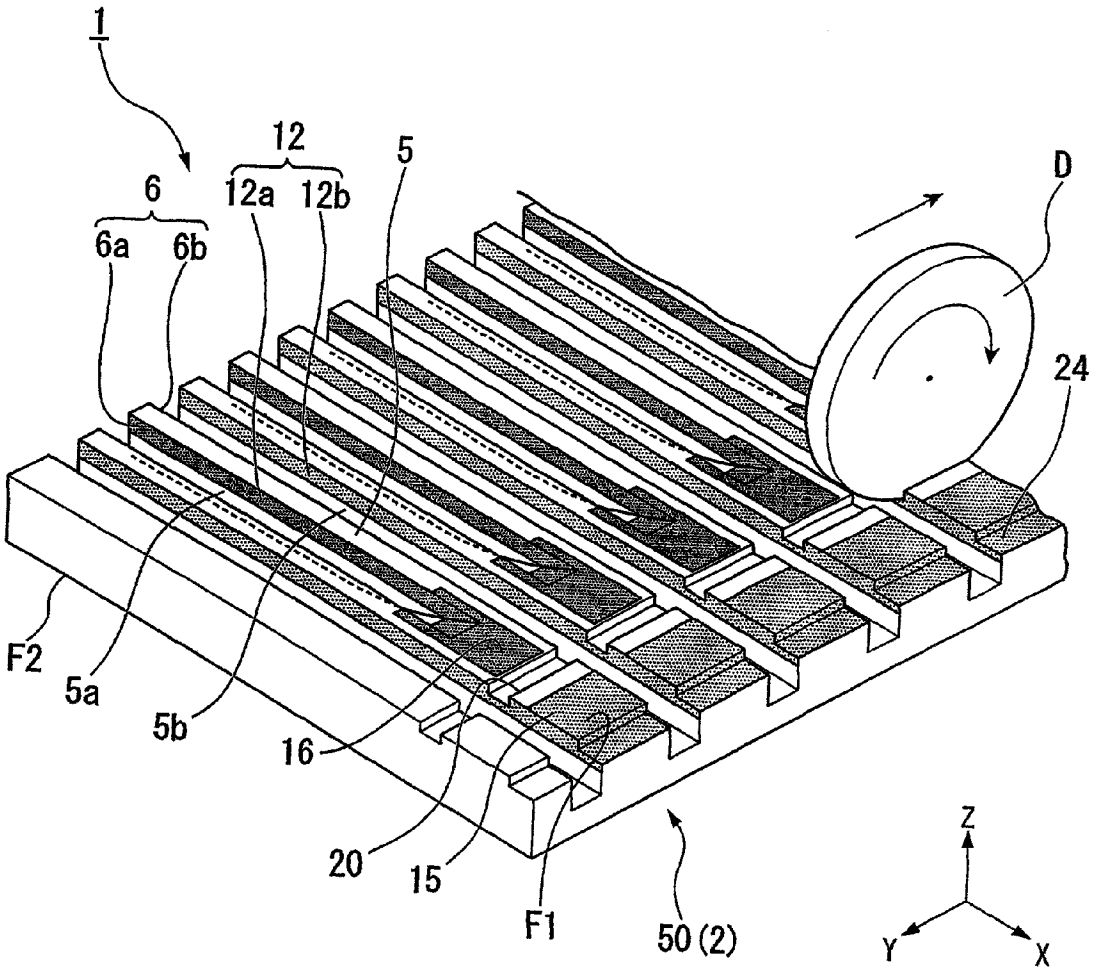
FIG. 7 is an explanatory drawing for a groove forming step in the method of manufacturing the liquid jet head according to the first embodiment.

FIG. 7 is an explanatory drawing for the groove forming step.

Then, in the groove forming step S22, as illustrated in FIG. 7, the groove 20 is formed, for example, by cutting the piezoelectric substrate 50 using the dicing blade D. Specifically, the first principal face F1 of the piezoelectric substrate 50 is cut by moving the dicing blade D along the Y direction between the individual electrode pads 15 and the common electrode pads 16 throughout the entire length in the Y direction of the piezoelectric substrate 50. As a result, the line of groove 20 is formed along the Y direction so as to be perpendicular to the non-ejection channels 6*b* between the individual electrode pads 15 and the common electrode pads 16 on the first principal face F1 of the piezoelectric substrate 50. When the groove 20 is formed, the actuator substrate 2 is completed.

Then, in the cover plate boding step S24, as illustrated in FIG. 4, the cover plate 3 is bonded to the first principal face F1 of the actuator substrate 2 with adhesive or the like. The liquid supply chamber 9 of the cover plate 3 communicates with the ejection channels 6*a* through the slits 9*a* formed on the bottom of the liquid supply chamber 9. Accordingly, liquid can be supplied to the ejection channels 6*a* from the liquid supply chamber 9. As illustrated in FIG. 3, the non-ejection channels 6*b* are blocked by the bottom face of the cover plate 3, and therefore do not communicate with the liquid supply chamber 9. Therefore, liquid cannot be supplied to the non-ejection channels 6*b* from the liquid supply chamber 9.

Then, in the nozzle plate bonding step S26, as illustrated in FIG. 1, the nozzle plate 4 is bonded to the −X side end face 2*b* of the actuator substrate 2 with adhesive or the like. As a result, the nozzle holes 4*a* are located on the −X side ends of the respective ejection channels 6*a* and thereby communicate with the respective ejection channels 6*a*. Therefore, the nozzle holes 4*a* can eject therefrom liquid inside the respective ejection channels 6*a*.

Then, in the flexible substrate adhering step S28, as illustrated in FIG. 4, the flexible substrate 25 is adhered to the first principal face F1 of the actuator substrate 2 at the +X side end 21 through anisotropic conductive adhesive (not illustrated) or the like. At this point, the individual electrode terminals 27 of the flexible substrate 25 are adhered to the respective individual electrode pads 15 of the actuator substrate 2. In addition, the common electrode terminals 28 of the flexible substrates 25 are adhered to the respective common electrode pads 16 of the actuator substrate 2. Accordingly, the individual electrode terminals 27 of the flexible substrate 25 and the individual electrode pads 15 of the actuator substrate 2 are electrically and mechanically connected to each other. In addition, the common electrode terminals 28 of the flexible substrates 25 and the common electrode pads 16 of the actuator substrate 2 are electrically and mechanically connected to each other.

At this point, the flexible substrate 25 is adhered to the actuator substrate 2 so that the connection wiring 26 of the flexible substrate 25 is arranged at the position corresponding to the groove 20 of the actuator substrate 2. Accordingly, the connection wiring 26 is arranged without making contact with the actuator substrate 2 in the groove 20. When the flexible substrate 25 is adhered to the actuator substrate 2, the process of manufacturing the liquid jet head 1 is completed.

Effect of First Embodiment

According to the first embodiment, the groove 20 is formed along the Y direction between the individual electrode pads 15 and the common electrode pads 16 on the first principal face F1 of the actuator substrate 2. Therefore, when the flexible substrate 25 is connected to the actuator substrate 2, by arranging the connection wiring 26 of the flexible substrate 25 at the position corresponding to the groove 20 of the actuator substrate 2, it is possible to prevent the connection wiring 26 of the flexible substrate 25 from making contact with the individual electrode pads 15 of the actuator substrate 2. Therefore, it is possible liquid supply chamber 9 to prevent electrical short circuit between the connection wiring 26 of the flexible substrate 25 and the individual electrode pads 15 and the individual electrodes 12*b* connected to the individual electrode pads 15 of the actuator substrate 2. Further, since electrical short circuit between the connection wiring 26 of the flexible substrate 25 and the individual electrode pads 15 and the individual electrodes 12*b* of the actuator substrate 2 can be prevented merely by forming the groove 20, it is possible to obtain the liquid jet head 1 at low cost.

The flexible substrate 25 which is connected to the actuator substrate 2 has the connection wiring 26 which is formed at the position corresponding to the groove 20 of the actuator substrate 2 and connects the common electrode terminals 28 to each other. Therefore, when the flexible substrate 25 is connected to the actuator substrate 2, the connection wiring 26 of the flexible substrate 25 can be reliably arranged at the position corresponding to the groove 20 of the actuator substrate 2. Therefore, it is possible to prevent electrical short circuit between the connection wiring 26 of the flexible substrate 25 and the individual electrode pads 15 and the individual electrodes 12*b* of the actuator substrate 2. Further, since electrical short circuit between the connection wiring 26 of the flexible substrate 25 and the individual electrode pads 15 and the individual electrodes 12*b* of the actuator substrate 2 can be prevented merely by forming the groove 20, it is possible to obtain the liquid jet head 1 at low cost.

The step portion 24 which is located one step lower than the first principal face F1 is formed on the +X side edge 21*a* of the actuator substrate 2. Therefore, when the flexible substrate 25 is connected to the first principal face F1 of the actuator substrate 2, contact between the +X side edge 21*a* in the first principal face F1 of the actuator substrate 2 and the flexible substrate 25 can be prevented. As a result, it is possible to prevent the flexible substrate 25 from being damaged.

Further, the configuration of the low-cost liquid jet head 1 that can prevent electrical short circuit between the connection wiring 26 of the flexible substrate 25 and the individual electrode pads 15 of the actuator substrate 2 can be preferably applied to the liquid jet head 1 in which the ejection channels 6*a* and the non-ejection channels 6*b* are alternately arrayed in the Y direction.

Further, the configuration of the low-cost liquid jet head 1 that can prevent electrical short circuit between the connection wiring 26 of the flexible substrate 25 and the individual electrode pads 15 of the actuator substrate 2 can be preferably applied to the liquid jet head 1 of a so-called edge shoot type.

The individual electrode pads 15 are formed across respective adjacent ones of the non-ejection channels 6*b*. Therefore, a wide surface area of each of the individual electrode pads 15 can be ensured. As a result, it is possible to easily connect the individual electrode terminals 27 on the flexible substrate 25 to the respective individual electrode pads 15 without performing precise positioning of the flexible substrate 25. In addition, since a wide cross-sectional area of each of the individual electrode pads 15 can be ensured, electric resistance of the individual electrode pads 15 can be reduced. As a result, the liquid jet head 1 having high electrical efficiency can be achieved.

The method of the first embodiment includes the electrode film forming step S18 for forming film of the electrode material 56 after the mask forming step S14. Therefore, the mask material 55 can be patterned into a desired shape to form the mask 55*a*, and the electrode material 56 can be formed into film having a desired shape. In addition, since the method includes the groove forming step S22, the groove 20 can be formed, for example, merely by cutting. As a result, when the flexible substrate 25 is connected to the actuator substrate 2, the connection wiring 26 of the flexible substrate 25 can be arranged at the position corresponding to the groove 20 of the actuator substrate 2. Therefore, it is possible to obtain the low-cost liquid jet head 1 that can prevent electrical short circuit between the connection wiring 26 of the flexible substrate 25 and the individual electrode pads 15 and the individual electrodes 12*b* connected to the individual electrode pads 15 of the actuator substrate 2.

Modified Example of First Embodiment

Figure 8:
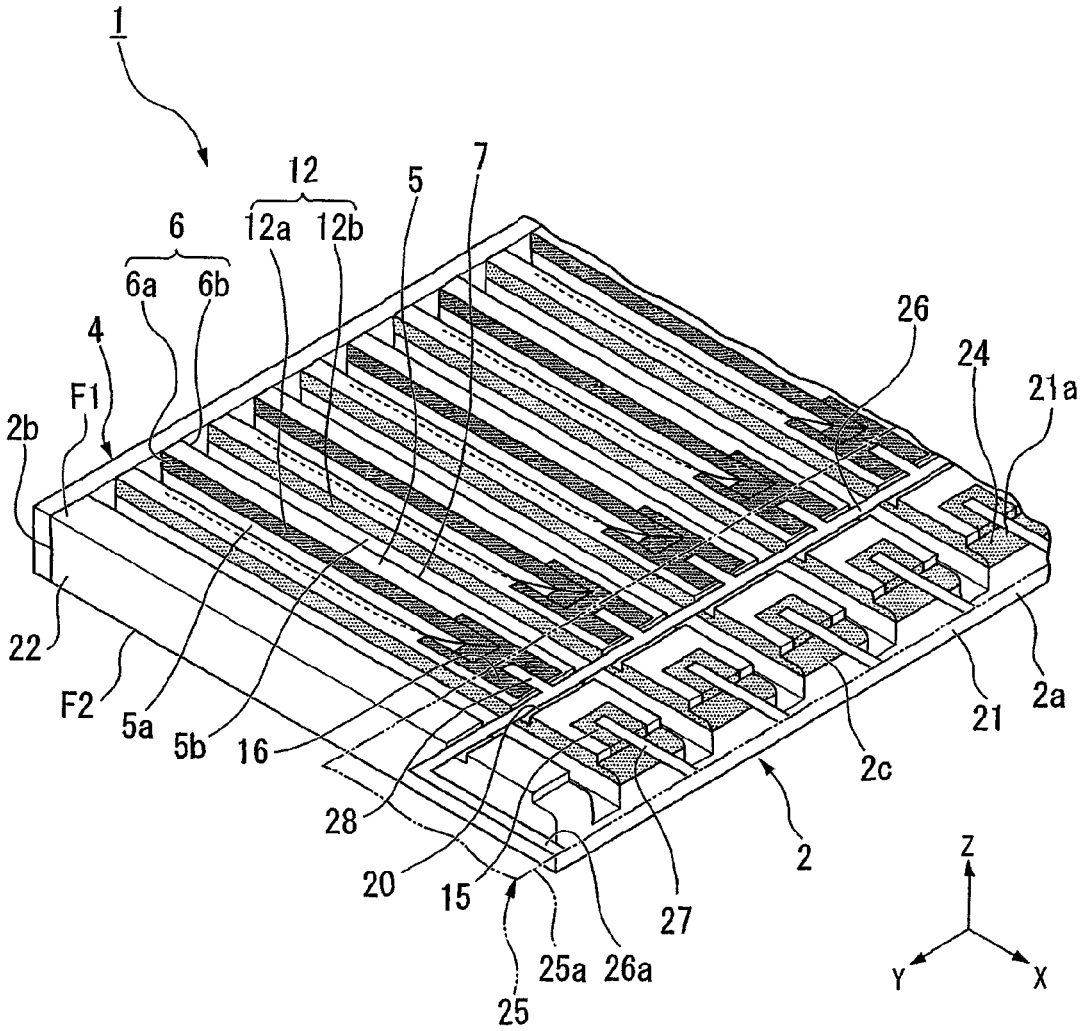
FIG. 8 is a perspective view of an actuator substrate according to a modified example of the first embodiment.

FIG. 8 is a perspective view of an actuator substrate 2 according to a modified example of the first embodiment.

Next, the actuator substrate 2 according to the modified example of the first embodiment will be described. Hereinbelow, a description of the same components as those of the first embodiment will be omitted, and only differences from the first embodiment will not be repeated.

In the actuator substrate 2 of the first embodiment, the individual electrode pads 15 are formed across respective adjacent ones of the non-ejection channels 6*b* on the first principal face F1 of the actuator substrate 2 (see FIG. 2).

On the other hand, as illustrate in FIG. 8, in the actuator substrate 2 according to the modified example of the first embodiment, individual electrode pads 15 are formed between respective adjacent ones of the non-ejection channels 6*b* on the first principal face F1 of the actuator substrate 2. In this manner, a forming range of the individual electrode pads 15 is not limited to the first embodiment.

Further, in the actuator substrate 2 according to the modified example of the first embodiment, a corner formed by the first principal face F1 of the actuator substrate 2 and the +X side end face 2*a* thereof is formed into a chamfered portion 2*c* which is round chamfered. In this manner, in the actuator substrate 2 according to the modified example of the first embodiment, the corner formed by the first principal face F1 of the actuator substrate 2 and the +X side end face 2*a* thereof is chamfered. Therefore, when the flexible substrate 25 is connected to the first principal face F1 of the actuator substrate 2, even if the flexible substrate 25 makes contact with the chamfered portion 2*c* of the actuator substrate 2, damage of the flexible substrate 25 can be reduced.

(Liquid Jet Apparatus)

Figure 9:
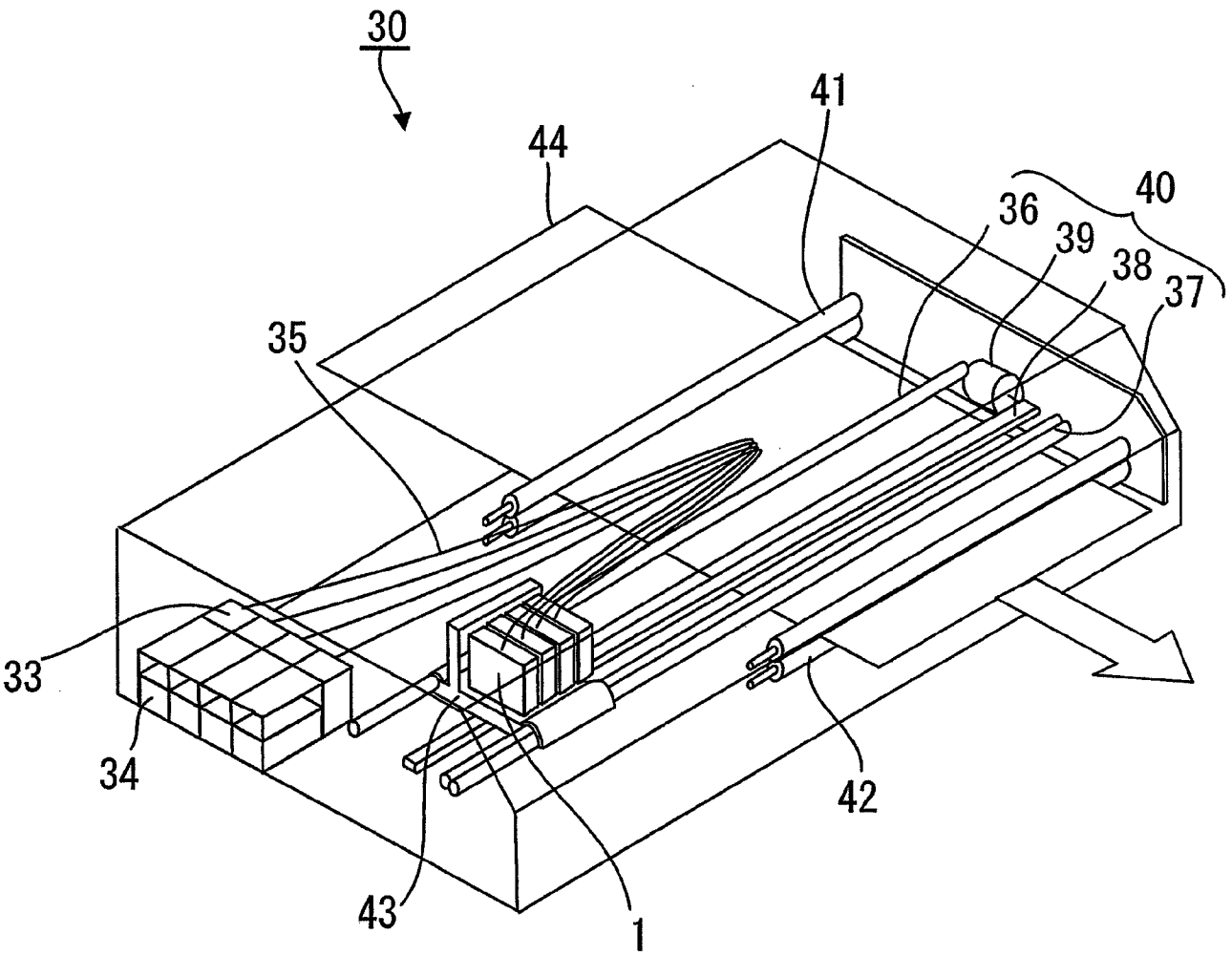
FIG. 9 is an explanatory drawing for a liquid jet apparatus that includes the liquid jet head according to the first embodiment.

FIG. 9 is an explanatory drawing for a liquid jet apparatus 30 that includes the liquid jet head 1 according to the first embodiment.

As illustrated in FIG. 9, the liquid jet apparatus 30 includes a plurality of liquid jet heads 1 (four liquid jet heads 1 in the present embodiment), a liquid supply tube 35 which supplies liquid to the liquid jet heads 1, a liquid pump 33 which supplies liquid to the liquid supply tube 35, and a plurality of liquid tanks 34 (four liquid tanks 34 in the present embodiment). Each of the liquid jet heads 1 includes a plurality of head chips, and ejects liquid from the nozzle holes 4*a* (see FIG. 1). As the liquid pump 33, a supply pump which supplies liquid to the liquid supply tube 35 is provided. Further, a pressure sensor or a flow sensor (not illustrated) may be provided to control the flow rate of liquid.

The liquid jet apparatus 30 includes a pair of conveyance units 41 and 42 which conveys a recording medium 44 such as paper in a main scanning direction, a carriage unit 43 which loads thereon the liquid jet heads 1, and a movement mechanism 40 which moves the liquid jet heads 1 in a sub-scanning direction that is perpendicular to the main scanning direction. A control unit (not illustrated) controls the liquid jet heads 1, the movement mechanism 40, and the conveyance units 41 and 42 to drive.

Each of the pair of conveyance units 41 and 42 extends in the sub-scanning direction, and includes a grid roller and a pinch roller which rotate with the roller surfaces thereof making contact with each other. The grid roller and the pinch roller are rotated around the respective shafts by a motor (not illustrated) to thereby convey the recording medium 44, which is sandwiched between the rollers, in the main scanning direction. The movement mechanism 40 includes a pair of guide rails 36 and 37 each of which extends in the sub-scanning direction, the carriage unit 43 which can slide along the pair of guide rails 36 and 37, an endless belt 38 to which the carriage unit 43 is coupled to move the coupled carriage unit 43 in the sub-scanning direction, and a motor 39 which drives the endless belt 38 to circulate via pulleys (not illustrated).

The carriage unit 43 loads thereon the liquid jet heads 1, and ejects, for example, four colors of liquid: yellow, magenta, cyan and black. The liquid tanks 34 store therein the respective colors of liquid, and supply the stored liquid to the respective liquid jet heads 1 through the liquid pump 33 and the liquid supply tube 35. Each of the liquid jet heads 1 ejects the corresponding color of liquid in response to a drive signal. Any pattern can be recorded on the recording medium 44 by controlling timing when the liquid jet heads 1 eject liquid, the rotation of the motor 39 which drives the carriage unit 43, and the conveyance speed of the recording medium 44.

In the liquid jet apparatus 30 of the present embodiment, the movement mechanism 40 moves the carriage unit 43 and the recording medium 44 to perform recording. Alternatively, however, the liquid jet apparatus may have a configuration in which a carriage unit 43 is fixed, and a movement mechanism 40 two-dimensionally moves a recording medium 44 to perform recording. That is, the movement mechanism may have any configuration as long as it can relatively move a liquid jet head 1 and a recording medium 44.

Since the liquid jet apparatus 30 of the present embodiment includes the low-cost liquid jet head 1 that can prevent electrical short circuit between the connection wiring 26 of the flexible substrate 25 and the individual electrode pads 15 of the actuator substrate 2, it is possible to obtain the liquid jet apparatus 30 with high reliability and low cost.

Second Embodiment

Figure 10:
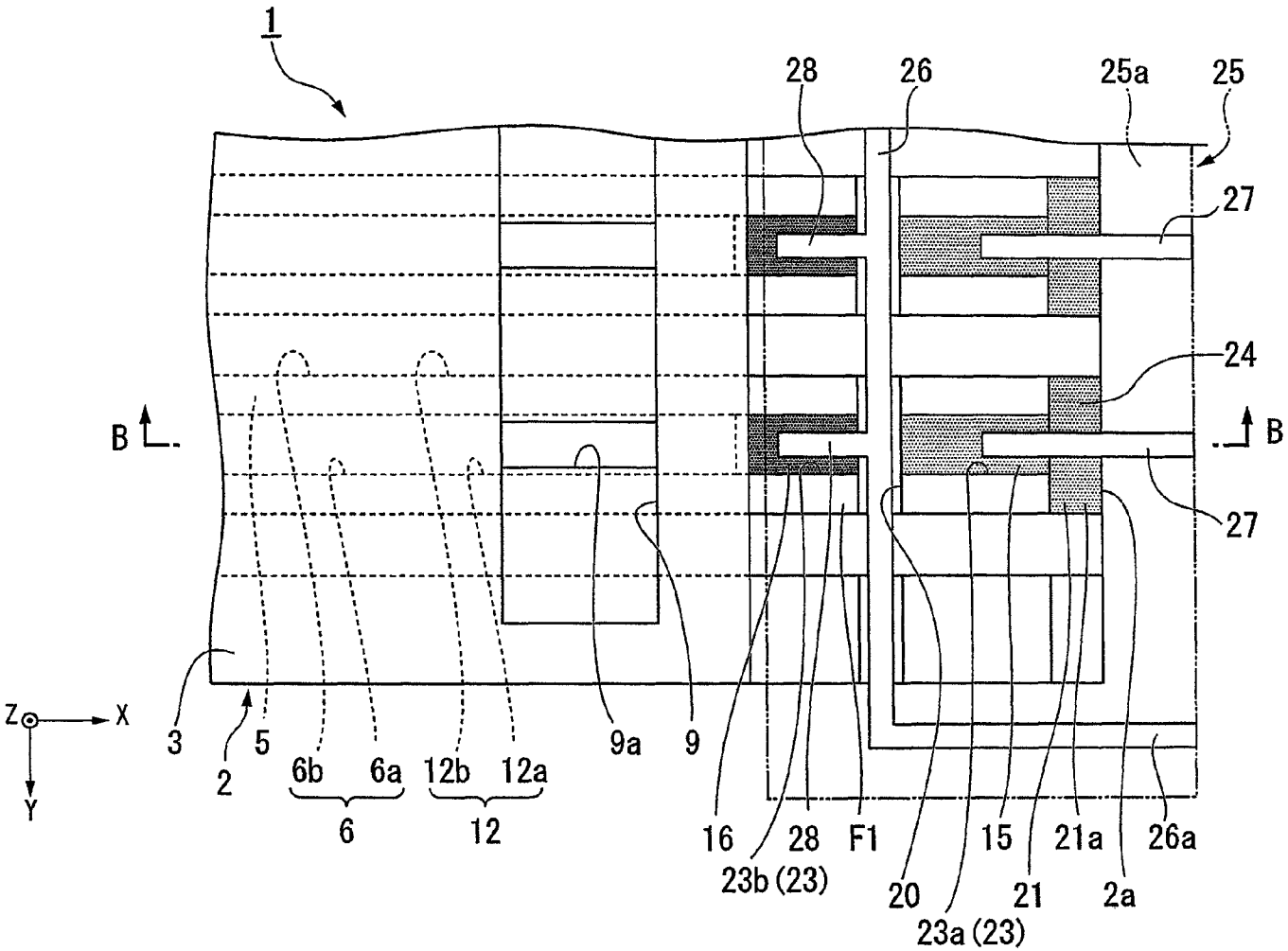
FIG. 10 is a plan view illustrating a liquid jet head according to a second embodiment with a flexible substrate attached to an actuator substrate.

FIG. 10 is a plan view illustrating a liquid jet head 1 according to the second embodiment with a flexible substrate 25 attached to an actuator substrate 2.

Next, the liquid jet head 1 according to the second embodiment and a method of manufacturing the liquid jet head 1 according to the second embodiment will be described.

In the liquid jet head 1 according to the first embodiment, the width in the Y direction of the common electrode pads 16 is wider than the width in the Y direction of the ejection channels 6*a* and narrower than the distance between adjacent ones of the non-ejection channels 6*b*. Further, the individual electrode pads 15 are formed across respective adjacent ones of the non-ejection channels 6*b* (see FIG. 3).

On the other hand, as illustrated in FIG. 10, the liquid jet head 1 according to the second embodiment is different from the first embodiment in that a plurality of shallow grooves 23 are formed on the +X side with respect to +X side ends of respective ejection channels 6*a*, and the width in the Y direction of common electrode pads 16 and the width in the Y direction of individual electrode pads 15 formed inside the shallow grooves 23 are equal to the width in the Y direction of the ejection channels 6*a*. Hereinbelow, a description of the same components as those of the first embodiment will be omitted, and only differences from the first embodiment will not be repeated.

Figure 11:
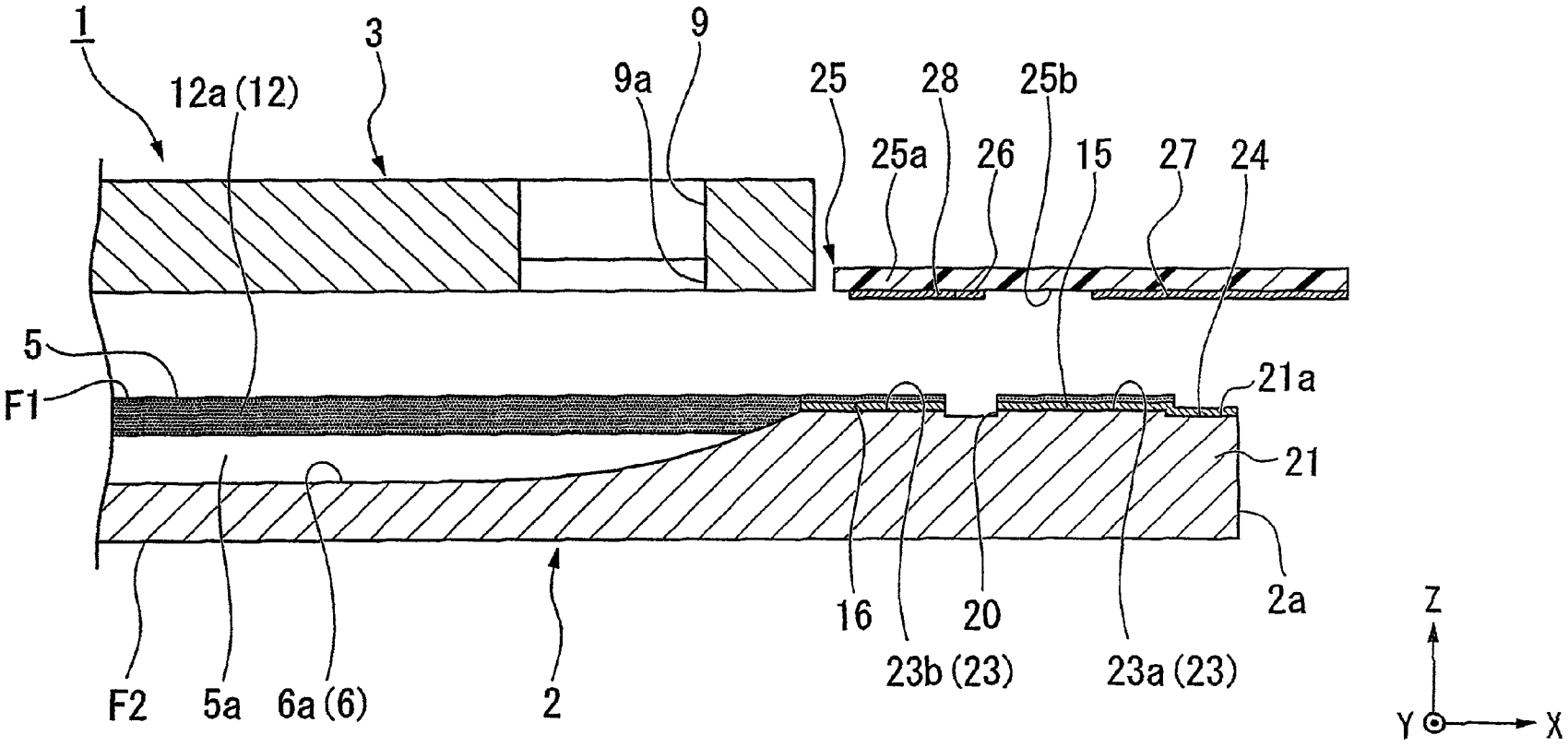
FIG. 11 is a side cross-sectional view taken along line B-B of FIG. 10 when the actuator substrate, a cover plate, and the flexible substrate according to the second embodiment are taken apart.

FIG. 11 is a side cross-sectional view taken along line B-B of FIG. 10 when an actuator substrate 2, a cover plate 3 and a flexible substrate 25 according to the second embodiment are taken apart.

As illustrated in FIG. 11, the shallow grooves 23 are formed on the actuator substrate 2 according to the second embodiment. The shallow grooves 23 are formed on a first principal face F1 of the actuator substrate 2 from the +X side ends of the respective ejection channels 6*a* toward a +X side end face 2*a* of the actuator substrate 2. The shallow grooves 23 of the present embodiment are formed from the +X side ends of the respective ejection channels 6*a* up to a step portion 24. The depth of the shallow grooves 23 is shallower than the depth of the ejection channels 6*a*, and also shallower than the depth of a groove 20 and the depth of the step portion 24.

As illustrated in FIG. 10, the width in the Y direction of the shallow grooves 23 is equal to the width in the Y direction of the ejection channels 6*a*. The width in the Y direction of the shallow groove 23 is wider than the width in the Y direction of individual electrode terminals 27 and the width in the Y direction of common electrode terminals 28 formed on the flexible substrate 25.

The groove 20 is formed so as to intersect the shallow grooves 23. The shallow grooves 23 are divided into +X side shallow grooves 23*a* and −X side shallow grooves 23*b* by the groove 20. The individual electrode pads 15 are formed inside the respective +X side shallow grooves 23*a*. The common electrode pads 16 are formed inside the respective −X side shallow grooves 23*b*. Therefore, the width in the Y direction of the common electrode pads 16 and the width in the Y direction of the individual electrode pads 15 are equal to the width in the Y direction of the ejection channels 6*a*.

The individual electrode terminals 27 of the flexible substrate 25 are connected to the respective individual electrode pads 15 inside the +X side shallow grooves 23*a*. The common electrode terminals 28 of the flexible substrate 25 are connected to the respective common electrode pads 16 inside the −X side shallow grooves 23*b*. Since the individual electrode pads 15 and the common electrode pads 16 are formed inside the shallow grooves 23, the individual electrode terminals 27 and the common electrode terminals 28 can be easily positioned inside the shallow grooves 23 by dropping the individual electrode terminals 27 and the common electrode terminals 28 which are arrayed in the Y direction into the respective shallow grooves 23. Therefore, it is possible to reliably connect the individual electrode pads 15 and the individual electrode terminals 27 to each other and the common electrode pads 16 and the common electrode terminals 28 to each other while easily positioning the individual electrode terminals 27 and the common electrode terminals 28.

Next, a method of manufacturing the liquid jet head 1 according to the second embodiment will be described.

Figure 12:
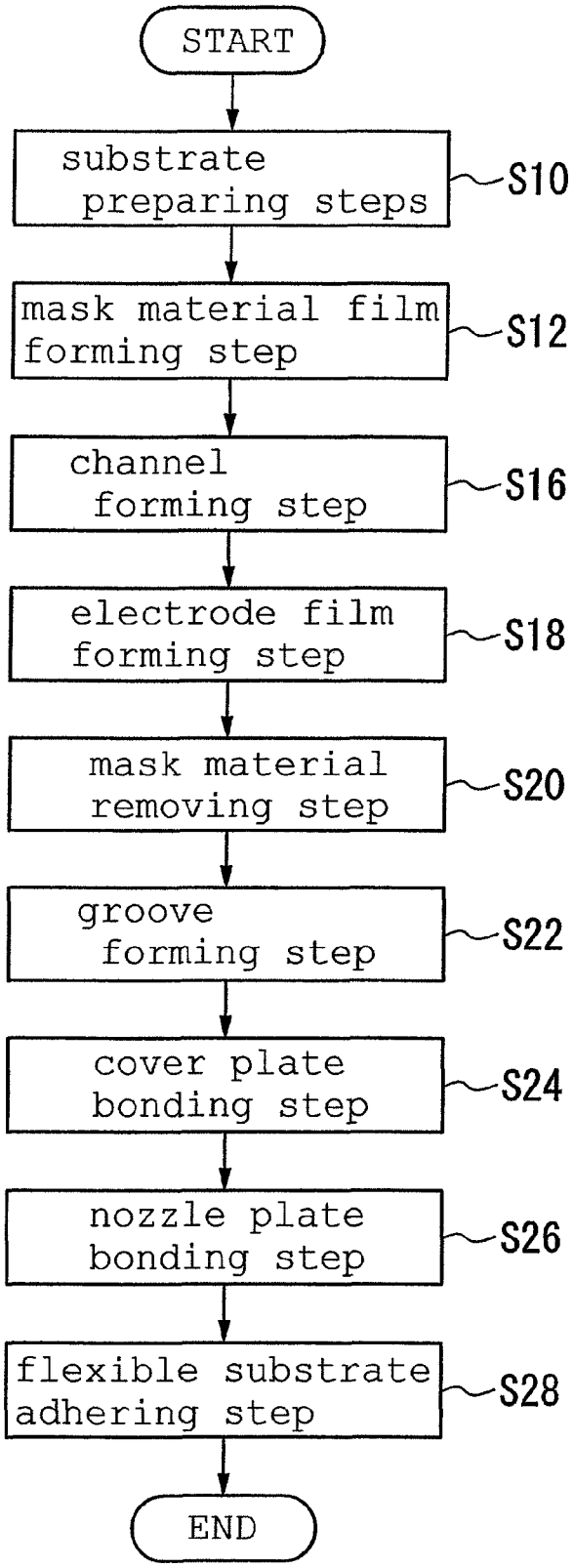
FIG. 12 is a flow chart illustrating main steps in a method of manufacturing the liquid jet head according to the second embodiment.
Figure 13A:
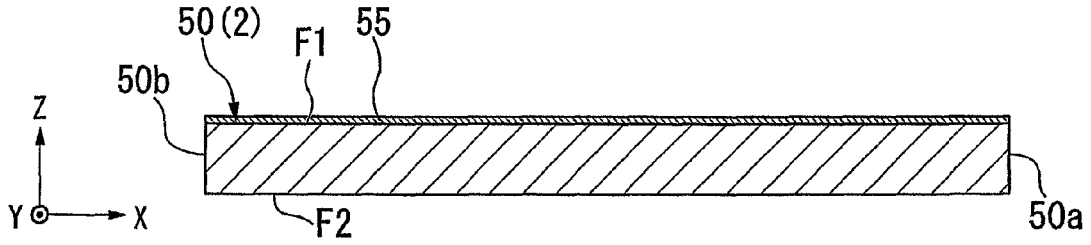
FIGS. 13A and 13B are explanatory drawings for the respective steps in the method of manufacturing the liquid jet head according to the second embodiment.
Figure 13B:
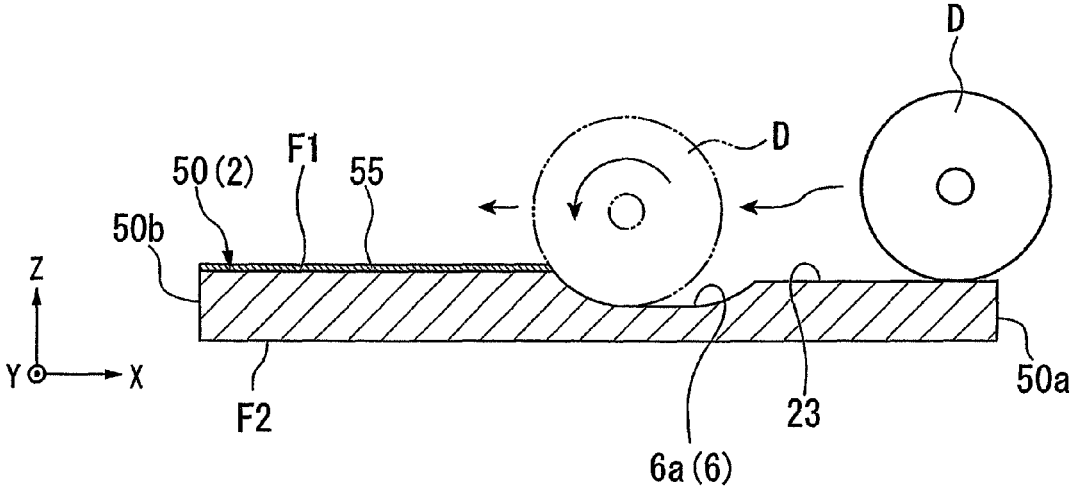

FIG. 12 is a flow chart illustrating main steps in the method of manufacturing the liquid jet head according to the second embodiment. FIGS. 13A and 13B are explanatory drawings for the respective steps in the method of manufacturing the liquid jet head according to the second embodiment. An XYZ orthogonal coordinate system in FIGS. 13A and 13B corresponds to the XYZ orthogonal coordinate system in FIGS. 10 and 11. FIGS. 13A and 13B correspond to the side cross-sectional view taken along line B-B of FIG. 10. See FIGS. 10 and 11 for reference signs used in the following description regarding the method of manufacturing the liquid jet head.

The method of manufacturing the liquid jet head according to the first embodiment includes the mask forming step S14 for patterning the mask material 55 to form the mask 55*a* which has the openings on the regions in which the individual electrode pads 15 and the common electrode pads 16 are to be formed (see FIGS. 5 and 6B, for example).

On the other hand, as illustrated in FIG. 12, the method of manufacturing the liquid jet head according to the second embodiment is different from the method of manufacturing the liquid jet head according to the first embodiment in that the method of the second embodiment does not include the mask forming step S14 (see FIG. 5). In the following description, only steps that are different from those of the method of manufacturing the liquid jet head according to the first embodiment will be described, and a description of the same steps will not be repeated.

As illustrated in FIG. 12, the method of manufacturing the liquid jet head according to the second embodiment mainly includes a substrate preparing step S10, a mask material film forming step S12, a channel forming step S16, an electrode film forming step S18, a mask material removing step S20, a groove forming step S22, a cover plate bonding step S24, a nozzle plate bonding step S26, and a flexible substrate adhering step S28. Hereinbelow, each of the steps S10 to S28 will be described.

In the mask material film forming step S12, as illustrated in FIG. 13A, film of a mask material 55 which made of, for example, a photosensitive resin is formed on the entire first principal face F1 of the piezoelectric substrate 50.

Then, in the channel forming step S16, as illustrated in FIG. 13B, the channels 6 are formed, for example, by cutting the piezoelectric substrate 50 using a dicing blade D. Further, when forming the ejection channels 6*a* in the channel forming step S16, the shallow grooves 23 which are shallower than the ejection channels 6*a* are formed on the +X side with respect to the respective ejection channels 6*a*. Specifically, the dicing blade D in a rotating state is moved from a +X side end face 50*a* of the piezoelectric substrate 50 up to a −X side end face 50*b* thereof while allowing the dicing blade D to abut on the first principal face F1 to cut the piezoelectric substrate 50 together with the mask material 55, thereby forming the shallow grooves 23 and the ejection channels 6*a*. In FIG. 13B, the dicing blade D when forming the shallow groove 23 is indicated by a solid line, and the dicing blade D when forming the ejection channel 6*a* is indicated by a two-dot chain line.

In the channel forming step S16, first, the dicing blade D is moved from the +X side end face 50*a* of the piezoelectric substrate 50 toward the −X side while allowing the dicing blade D to abut on the piezoelectric substrate 50 at a position corresponding to the depth in the Z direction of the shallow groove 23 to cut the piezoelectric substrate 50. Then, the dicing blade D is moved toward the −Z side at a position in the X direction at which the ejection channel 6*a* is to be formed to cut the piezoelectric substrate 50. Then, the dicing blade D is moved toward the −X side end face 50*b* of the piezoelectric substrate 50 while allowing the dicing blade D to abut on the piezoelectric substrate 50 at a position corresponding to the depth in the Z direction of the ejection channel 6*a* to further cut the piezoelectric substrate 50. Then, when the dicing blade D reaches the −X side end face 50*b* of the piezoelectric substrate 50, the shallow groove 23 and the ejection channel 6*a* are formed on the first principal face F1 of the piezoelectric substrate 50.

In the channel forming step S16, after forming the ejection channels 6*a* and the shallow grooves 23, the step portion 24 is formed on a +X side edge 51*a* of the piezoelectric substrate 50 on the same side as the first principal face F1.

In the channel forming step S16, the piezoelectric substrate 50 is cut together with the mask material 55. Therefore, after finishing the channel forming step S16, the piezoelectric substrate 50 is exposed from the mask material 55 in regions in which the ejection channels 6*a*, the non-ejection channels 6*b*, the shallow grooves 23, and the step portion 24 are formed.

Then, in the electrode film forming step S18, an electrode material is deposited on the first principal face F1 of the piezoelectric substrate 50 by oblique deposition.

Then, in the mask material removing step S20, the mask material 55 is removed, for example, by lift-off, and a part of the electrode material deposited on the mask material 55 is removed at the same time. As a result, film of the electrode material is formed on the regions in which the ejection channels 6*a*, the non-ejection channels 6*b*, the shallow grooves 23, and the step portions 24 are formed, the regions being exposed from the mask material 55. The film of the electrode material formed inside the ejection channels 6*a* corresponds to the common electrodes 12*a*, and the film of the electrode material formed inside the non-ejection channels 6*b* corresponds to the individual electrodes 12*b*.

Figure 14:
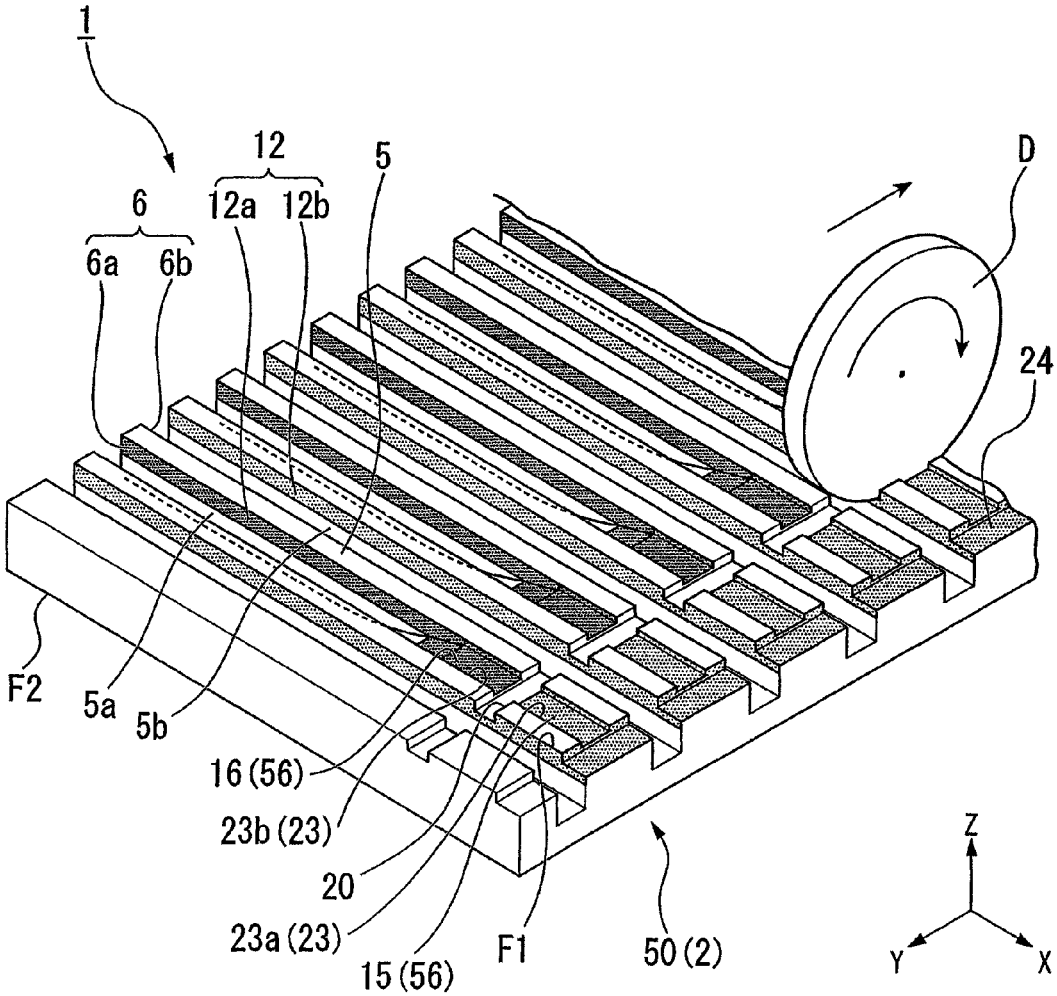
FIG. 14 is an explanatory drawing for a groove forming step in the method of manufacturing the liquid jet head according to the second embodiment.

FIG. 14 is an explanatory drawing for the groove forming step.

Then, in the groove forming step S22, as illustrated in FIG. 14, the groove 20 is formed, for example, by cutting the piezoelectric substrate 50 using the dicing blade D. Specifically, the first principal face F1 of the piezoelectric substrate 50 is cut by moving the dicing blade D along the Y direction at a position in the X direction between the step portion 24 and the ejection channels 6*a* throughout the entire length in the Y direction of the piezoelectric substrate 50. As a result, the shallow grooves 23 are divided into the +X side shallow grooves 23*a* and the −X side shallow grooves 23*b*. In addition, the electrode material 56 inside the shallow grooves 23 is divided. Then, the individual electrode pads 15 are formed inside the respective +X side shallow grooves 23*a*, and the common electrode pads 16 are formed inside the respective −X side shallow grooves 23*b*. When the groove 20 is formed, the actuator substrate 2 is completed.

Effect of Second Embodiment

According to the second embodiment, the shallow grooves 23 are formed from the +X side ends of the ejection channels 6*a* toward the +X side end face 2*a* of the actuator substrate 2. Therefore, when forming the ejection channels 6*a*, for example, by cutting, the shallow grooves 23 can be formed merely by changing the depth of cutting. Therefore, it is possible to easily form the shallow grooves 23 within the channel forming step S16. Further, the groove 20 is formed so as to intersect the shallow grooves 23. Therefore, the common electrode pads 16 and the individual electrode pads 15 can be easily formed by forming the groove 20 so as to interest the shallow grooves 23, for example, by cutting after forming the film of the electrode material 56 inside the shallow grooves 23 to thereby divide the film of the electrode material 56 formed inside the shallow grooves 23 by the groove 20. In this manner, since the common electrode pads 16 and the individual electrode pads 15 can be formed without using a mask, the liquid jet head 1 that can prevent electrical short circuit between the connection wiring 26 of the flexible substrate 25 and the individual electrode pads 15 and the individual electrodes 12*b* of the actuator substrate 2 can be formed at low cost.

The width of the common electrode pads 16 and the width of the individual electrode pads 15 are equal to the width of the ejection channels 6*a*. Therefore, it is possible to reduce the width of the common electrode pads 16 and the width of the individual electrode pads 15 as much as possible. As a result, the width of the liquid jet head 1 can be reduced.

The method of the second embodiment includes the channel forming step S16 for forming the ejection channels 6*a* and the non-ejection channels 6*b* on the piezoelectric substrate 50 after the mask material film forming step S12. Therefore, when forming the ejection channels 6*a* and the non-ejection channels 6*b*, for example, by cutting, the mask material 55 that corresponds to each of the channels 6 (6*a*, 6*b*) can be removed by cutting. Accordingly, the film of the electrode material 56 can be formed on the regions corresponding to the respective channels 6 (6*a*, 6*b*) exposed from the mask material 55 in the next electrode film forming step S18. Therefore, it is possible to form the film of the electrode material 56 without using a mask patterned by, for example, a photolithography technique to form the common electrodes 12*a* and the individual electrodes 12*b*. Further, the shallow grooves 23 which are shallower than the ejection channels 6*a* are formed in the channel forming step S16. Therefore, the film of the electrode material 56 can be formed also on the regions corresponding to the shallow grooves 23 exposed from the mask material 55 in the next electrode film forming step S18. Further, since the method includes the groove forming step S22 for forming the groove 20, it is possible to easily form the common electrode pads 16 and the individual electrode pads 15 by forming the groove 20 so as to intersect the shallow grooves 23, for example, by cutting to divide the film of the electrode material 56 formed inside the shallow grooves 23 by the groove 20. In this manner, since the common electrode pads 16 and the individual electrode pads 15 can be formed without patterning the mask material 55, the method of manufacturing the liquid jet head 1 can be simplified. Therefore, the liquid jet head 1 that can prevent electrical short circuit between the connection wiring 26 of the flexible substrate 25 and the individual electrode pads 15 and the individual electrodes 12*b* connected to the individual electrode pads 15 of the actuator substrate 2 can be formed at low cost.

Note that the technical scope of the invention is not limited to the above embodiments, and various modifications can be made without departing from the scope of the invention.

In each of the embodiments, there has been described, as an example, the liquid jet head 1 of a so-called edge shoot type in which the nozzle holes 4*a* are located on the −X side end 22 of the actuator substrate 2 (the ejection channels 6*a*). However, the application of the present invention is not limited to the edge shoot type liquid jet head 1. For example, the present invention can also be applied to a so-called side shoot type liquid jet head in which the nozzle holes 4*a* are located on the second principal face F2 of the actuator substrate 2 at positions near the centers in the X direction of the respective ejection channels 6*a*. Further, the present invention can also be applied to a so-called through flow type liquid jet head that is a side shoot type liquid jet head and includes a liquid supply chamber and a liquid discharge chamber on a cover plate.

In each of the embodiments, the drive electrodes 12 are formed on the side faces of the walls 5 of the actuator substrate 2 so as to be located on the +Z side with respect to the centers in the Z direction of the walls 5. However, the placing range of the drive electrodes 12 is not limited to the above embodiments. For example, the drive electrodes 12 may be placed in proximity to the bottoms of the channels 6.

For example, a chevron type liquid jet head in which a piezoelectric material polarized in opposite directions vertically in the depth direction of the channels 6 is laminated can be used in the present invention. In this case, by forming the drive electrodes 12 throughout the entire side faces 5*a* and 5*b* of the walls 5, each of the walls 5 is deformed into a V-shape curved at the center in the height direction thereof due to a piezoelectric slide effect. As a result, it is possible to deform the walls 5 with low voltage.

In each of the embodiments, in the channels 6, the ejection channels 6*a* and the non-ejection channels 6*b* are alternately arrayed. However, the form of the channels 6 is not limited thereto. For example, the ejection channels 6*a* and the non-ejection channels 6*b* may not be alternately arrayed.

In the actuator substrate 2 of each of the embodiments, the step portion 24 which is located one step lower than the first principal face F1 is formed on the +X side edge 21*a* of the actuator substrate 2. However, the step 24 may not be formed.

Further, the actuator substrate 2 according to the modified example of the first embodiment has the chamfered portion 2*c* which is round chamfered and formed at the +X side end 21 on the first principal face F1. However, the chamfering shape of the chamfered portion 2*c* is not limited to a round chamfering, and may, for example, be a C chamfering.

In addition to the above, the components in the above embodiments can be appropriately replaced with well-known components without departing from the scope of the invention.

What is claimed is:

1. A liquid jet head comprising:

an actuator substrate including a plurality of ejection channels communicating with nozzle holes configured to eject liquid from the ejection channels and a plurality of non-ejection channels configured to be incapable of ejecting the liquid from the non-ejection channels, the ejection channels and the non-ejection channels being opened at least on a first principal face of the actuator substrate and arrayed in a width direction perpendicular to a longitudinal direction of the ejection channels and the non-ejection channels on the first principal face;

a plurality of common electrodes formed on side faces of the ejection channels; and a plurality of individual electrodes formed on side faces of the non-ejection channels, the actuator substrate further including:

a plurality of individual electrode pads configured to be connected to the individual electrodes, the individual electrode pads being formed on the first principal face of the actuator substrate at positions located on an end on a first side of the actuator substrate;

a plurality of common electrode pads configured to be connected to the common electrodes, the common electrode pads being formed on the first principal face of the actuator substrate at positions located on a second side of the actuator substrate with respect to the individual electrode pads opposite the first side, a groove formed along the width direction between the individual electrode pads and the common electrode pads on the first principal face of the actuator substrate for isolating the individual electrode pads and the common electrode pads from one another;

an external substrate configured to be connected to the actuator substrate, the external substrate including: a plurality of individual electrode terminals formed at positions corresponding to the individual electrode pads of the actuator substrate, the individual electrode terminals being configured to be connected to the individual electrode pads; and a plurality of common electrode terminals formed at positions corresponding to the common electrode pads of the actuator substrate, the common electrode terminals being configured to be connected to the common electrode pads; and connection wiring configured to connect the common electrode terminals of the external substrate to each other, the connection wiring being formed along the groove of the actuator substrate between the individual electrode terminals and the common electrode terminals to prevent an electrical short circuit between the connection wiring and the individual electrodes.

2. The liquid jet head according to claim 1, wherein the actuator substrate further includes a plurality of shallow grooves which are shallower than the ejection channels, the plurality of shallow grooves being formed on the first principal face of the actuator substrate from ends of the ejection channels toward an end face of the actuator substrate on the first side thereof; and wherein the groove is formed so as to intersect the shallow grooves.

3. The liquid jet head according to claim 1, wherein a step portion located one step lower than the first principal face is formed on an edge on the first side of the actuator substrate.

4. The liquid jet head according to claim 1, wherein a corner formed by the first principal face of the actuator substrate and an end face on the first side of the actuator substrate is chamfered.

5. The liquid jet head according to claim 1, wherein the ejection channels and the non-ejection channels are alternately arrayed in the width direction.

6. The liquid jet head according to claim 1, wherein the nozzle holes are located on ends on a second side of the ejection channels.

7. The liquid jet head according to claim 1, wherein the nozzle holes are located on a second principal face of the actuator substrate at positions on middle parts in the longitudinal direction of the ejection channels.

8. The liquid jet head according to claim 1, wherein the non-ejection channels are formed from an end face on the first side of the actuator substrate up to an end face on the second side of the actuator substrate, and wherein the individual electrode pads are formed across respective adjacent ones of the non-ejection channels.

9. The liquid jet head according to claim 1, wherein the width of the common electrode pads and the width of the individual electrode pads are equal to the width of the ejection channels.

10. A method of manufacturing the liquid jet head according to claim 1, the method comprising:

a mask material film forming step for forming a film of a mask material on a piezoelectric substrate constituting a base of the actuator substrate;

a mask forming step for patterning the mask material to form a mask having openings at least on regions in which the individual electrode pads and the common electrode pads are to be formed;

a channel forming step for forming the ejection channels and the non-ejection channels on the piezoelectric substrate;

an electrode film forming step for forming a film of an electrode material;

a mask material removing step for removing the mask material; and a groove forming step for forming the groove.

11. A method of manufacturing the liquid jet head according to claim 1, the method comprising:

a mask material film forming step for forming a film of a mask material on a piezoelectric substrate constituting a base of the actuator substrate;

a channel forming step for forming the ejection channels and the non-ejection channels on the piezoelectric substrate;

an electrode film forming step for forming a film of an electrode material;

a mask material removing step for removing the mask material; and a groove forming step for forming the groove, wherein shallow grooves shallower than the ejection channels are formed on the first side with respect to the ejection channels formed in the channel forming step.

12. A liquid jet apparatus comprising:

the liquid jet head according to claim 1;

a movement mechanism configured to relatively move the liquid jet head and a recording medium;

a liquid supply tube configured to supply liquid to the liquid jet head; and a liquid tank configured to supply the liquid to the liquid supply tube.

13. The liquid jet head according to claim 1, wherein the plurality of common electrode pads are formed between the plurality of ejection channels and the plurality of individual electrode pads.

14. A liquid jet head comprising:

an actuator substrate including a groove array formed by alternately arraying on a principal surface of the actuator substrate a plurality of ejection channels which are configured to eject a liquid and a plurality of non-ejection channels which are not configured to eject the liquid;

a plurality of common electrodes formed on side surfaces of the ejection channels;

a plurality of individual electrodes formed on side surfaces of the non-ejection channels;

a plurality of individual electrode pads formed on the principal surface of the actuator substrate and configured to be connected to the individual electrodes;

a plurality of common electrode pads formed on the principal surface of the actuator substrate and configured to be connected to the common electrodes;

a groove formed on the principal surface of the actuator substrate between the individual electrode pads and the common electrode pads for isolating the individual electrode pads and the common electrode pads from one another;

an external substrate having a plurality of individual electrode terminals configured to be connected to the individual electrode pads and having a plurality of common electrode terminals configured to be connected to the common electrode pads; and connection wiring configured to connect the common electrode terminals of the external substrate to each other, the connection wiring being formed along the groove between the individual electrode terminals and the common electrode terminals to prevent an electrical short circuit between the connection wiring and the individual electrodes.

15. The liquid jet head according to claim 14, further comprising a nozzle plate having a plurality of nozzle holes communicating with the respective plurality of ejection channels and through which the liquid from the plurality of ejection channels is ejected.

16. The liquid jet head according to claim 14, wherein a corner formed by the principal surface of the actuator substrate and an end surface the actuator substrate is chamfered.

17. The liquid jet head according to claim 14, wherein the width of the common electrode pads and the width of the individual electrode pads are equal to the width of the ejection channels.

18. The liquid jet head according to claim 14, wherein the plurality of common electrode pads are formed between the plurality of ejection channels and the plurality of individual electrode pads.

19. A liquid jet apparatus comprising:

the liquid jet head according to claim 14;

a movement mechanism configured to relatively move the liquid jet head and a recording medium;

a liquid supply tube configured to supply liquid to the liquid jet head; and a liquid tank configured to supply the liquid to the liquid supply tube.

* * * * *